US011412866B2

(12) United States Patent
Fagundes et al.

(10) Patent No.: US 11,412,866 B2
(45) Date of Patent: Aug. 16, 2022

(54) SHELF AND DRAWER ASSEMBLIES FOR STORING BOTTLES

(71) Applicant: WHIRLPOOL CORPORATION, Benton Harbor, MI (US)

(72) Inventors: Tiago D. Fagundes, Joinville (BR); Leonardo K. Granemann, Joinville (BR); Acacio S. Junior, Joinville (BR); Spencer F. Souza, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 17/064,709

(22) Filed: Oct. 7, 2020

(65) Prior Publication Data

US 2021/0137288 A1 May 13, 2021

Related U.S. Application Data

(63) Continuation of application No. 16/680,720, filed on Nov. 12, 2019, now Pat. No. 10,820,725.

(51) Int. Cl.
*A47F 7/28* (2006.01)
*A47B 88/988* (2017.01)
(Continued)

(52) U.S. Cl.
CPC ..... *A47F 7/283* (2013.01); *A47B 73/002* (2013.01); *A47B 88/988* (2017.01);
(Continued)

(58) Field of Classification Search
CPC .... F25D 25/021; F25D 25/024; F25D 25/025; F25D 2331/803; F25D 2325/021; F25D 2325/023; A47B 88/988; A47B 96/025; A47B 73/00; A47B 73/002; A47B 73/008; A47B 2201/175; A47F 7/28; A47F 7/283
See application file for complete search history.

(56) References Cited

U.S. PATENT DOCUMENTS 2,498,402 A 2/1950 Earle
3,117,688 A * 1/1964 Walstad ..... B65D 25/06 217/7

(Continued)

FOREIGN PATENT DOCUMENTS

DE 10121804 A1 * 11/2002 ..... A47B 88/988
EP 1442674 A1 8/2004

(Continued)

*Primary Examiner* — Andrew M Roersma
(74) *Attorney, Agent, or Firm* — Price Heneveld LLP

(57) ABSTRACT

A shelf assembly includes a frame assembly having a side member, wherein the frame assembly is operable between stowed and extended positions. A rack assembly includes a first rack hingedly coupled to a second rack. The first rack and the second rack are pivotally coupled to the side member of the frame assembly, and the rack assembly is operable between first and second positions. The first rack and the second rack are angled towards a pivot axis defined between the first rack and the second rack when the rack assembly is in the second position. The rack assembly moves from the first position to the second position as the frame assembly moves from the stowed position to the extended position.

10 Claims, 18 Drawing Sheets

(51) Int. Cl.
*A47B 73/00* (2006.01)
*A47B 96/02* (2006.01)
*F25D 25/02* (2006.01)

(52) U.S. Cl.
CPC ..... *A47B 96/025* (2013.01); *F25D 25/024* (2013.01); *F25D 25/025* (2013.01); *F25D 2325/021* (2013.01); *F25D 2325/023* (2013.01); *F25D 2331/803* (2013.01)

(56) References Cited

U.S. PATENT DOCUMENTS

| | | | | |
|---|---|---|---|---|
| 4,441,771 | A | 4/1984 | Roesler | |
| 4,620,489 | A | 11/1986 | Albano | |
| 4,646,658 | A | 3/1987 | Lee | |
| 4,678,247 | A | 7/1987 | Pink | |
| 4,944,477 | A | 7/1990 | Hendren | |
| D511,785 | S | 11/2005 | Aldous et al. | |
| 7,063,219 | B2 | 6/2006 | Fann et al. | |
| 7,140,703 | B1 | 11/2006 | Holdgate, III et al. | |
| 7,197,888 | B2 | 4/2007 | LeClear et al. | |
| 7,350,647 | B2 | 4/2008 | Haller et al. | |
| 7,380,410 | B2 | 6/2008 | Rand et al. | |
| 7,472,974 | B2 | 1/2009 | Czach et al. | |
| 7,665,326 | B2 | 2/2010 | LeClear et al. | |
| 8,220,887 | B2 * | 7/2012 | Watts | F25D 25/025 312/402 |
| 9,222,723 | B2 | 12/2015 | Seeley | |
| 9,434,918 | B1 | 9/2016 | Narasimhan et al. | |
| 9,737,139 | B1 | 8/2017 | Knake | |
| 9,833,072 | B1 | 12/2017 | Knake | |
| 10,314,412 | B2 | 6/2019 | Turner et al. | |
| 10,653,122 | B2 * | 5/2020 | Lu | F25D 25/025 |
| 2007/0228909 | A1 * | 10/2007 | Hwang | F25D 25/024 312/408 |
| 2013/0146552 | A1 | 6/2013 | Grimes | |

FOREIGN PATENT DOCUMENTS

| | | | | | |
|---|---|---|---|---|---|
| JP | H-03113272 | A | * | 5/1991 | F25D 25/025 |
| JP | 2001120251 | A | | 5/2001 | |
| JP | 2004251599 | A | * | 9/2004 | F25D 25/025 |
| KR | 20040049679 | A | | 6/2004 | |
| KR | 101059791 | B1 | * | 8/2011 | F25D 25/025 |

* cited by examiner

SHELF AND DRAWER ASSEMBLIES FOR STORING BOTTLES

CROSS-REFERENCE TO RELATED APPLICATION

This application is a continuation of U.S. patent application Ser. No. 16/680,720, filed on Nov. 12, 2019, entitled SHELF AND DRAWER ASSEMBLIES FOR STORING BOTTLES, the entire disclosure of which is hereby incorporated by reference.

BACKGROUND OF THE DISCLOSURE

The present disclosure generally relates to shelf and drawer assemblies used to store and present bottles, and more specifically, to shelf assemblies having pivoting rack systems for supporting bottles in horizontal and include positions and drawer assemblies that provide for vertical loading and inclined storage configurations for bottles.

SUMMARY OF THE DISCLOSURE

According to one aspect of the present disclosure, a shelf assembly includes a frame assembly that is operably coupled to at least one rail member at a side member of the frame assembly for movement between stowed and extended positions. A rack assembly includes a front rack hingedly coupled to a rear rack. The front rack and the rear rack are pivotally coupled to the side member of the frame assembly. A linkage assembly includes first and second arms. The first arm includes a first end that is slideably coupled to the rail member and the side member of the frame assembly and a second end that is slideably coupled to the side member of the frame assembly. The second end of the first arm is rotatably coupled to a first end of the second arm. A second end of the second arm is operably coupled to the rack assembly.

According to another aspect of the present disclosure, a shelf assembly includes a frame assembly that is operably coupled to a slide assembly for movement between stowed and extended positions. A rack assembly includes a front rack that is hingedly coupled to a rear rack. The front rack and the rear rack are pivotally coupled to a side member of the frame assembly. A guide pin is operably coupled to the rack assembly and outwardly extends therefrom. A guide member includes an elongate slot, and a portion of the guide pin is received in the elongate slot for movement therealong. The guide pin moves from a first end of the elongate slot to a second end of the elongate slot as the frame assembly moves from the stowed position to the extended position.

According to yet another aspect of the present disclosure, a shelf assembly includes a frame assembly that is operably coupled to a slide assembly at a side member of the frame assembly for movement of the frame assembly between stowed and extended positions. A rack assembly includes a first rack hingedly coupled to a second rack. The first rack and the second rack are pivotally coupled to the side member of the frame assembly. The rack assembly is operable between first and second positions. The first rack and the second rack are angled towards a pivot axis defined between the first rack and the second rack in the second position. The rack assembly moves from the first position to the second position as the frame assembly moves from the stowed position to the extended position.

These and other features, advantages, and objects of the present disclosure will be further understood and appreciated by those skilled in the art by reference to the following specification, claims, and appended drawings.

Figure 1A:
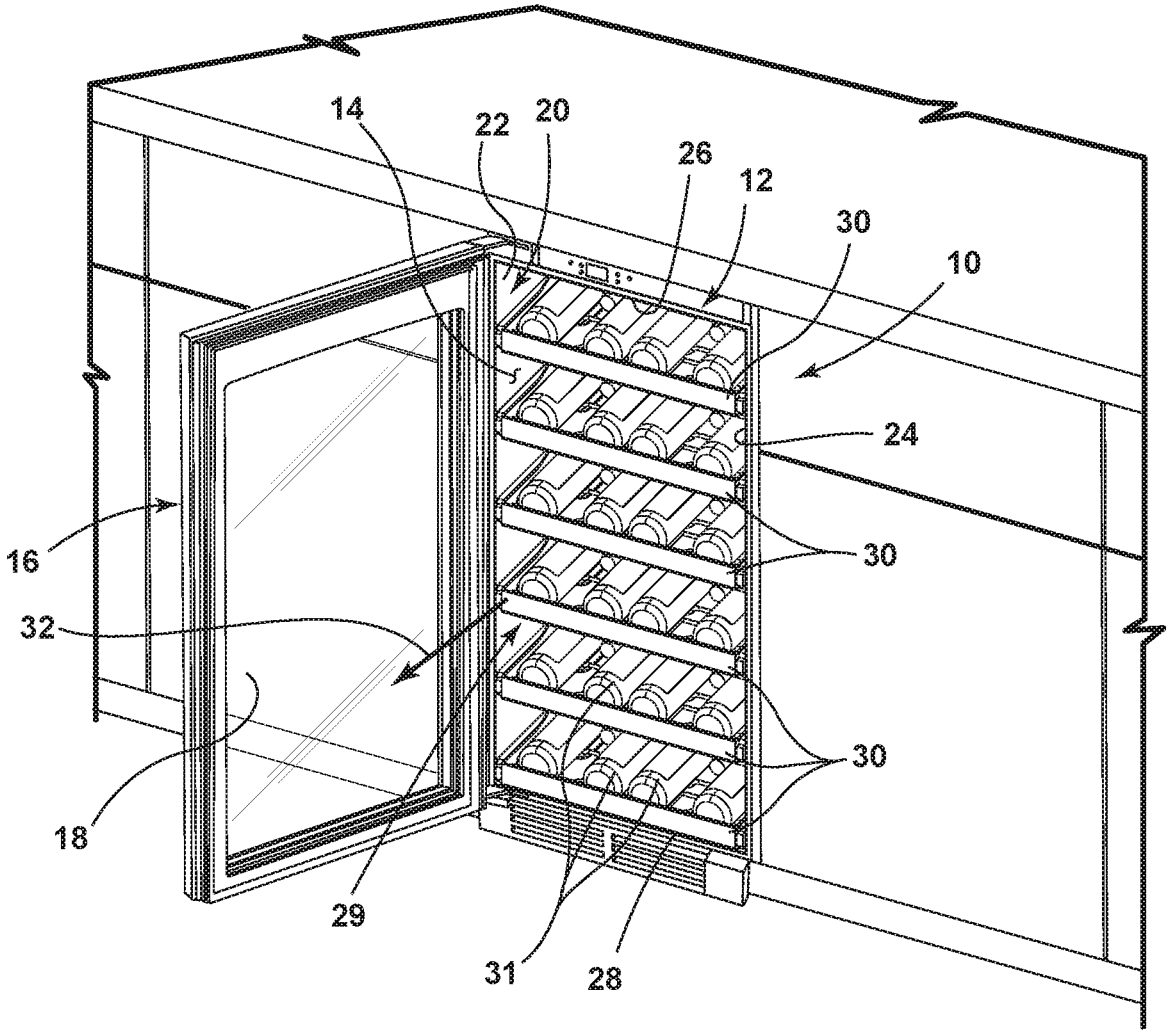
FIG. 1A is a top perspective view of a refrigerated appliance having a plurality of shelf assemblies disposed therein in a stowed position.

The components in the figures are not necessarily to scale, emphasis instead being placed upon illustrating the principles described herein.

DETAILED DESCRIPTION

The present illustrated embodiments reside primarily in combinations of method steps and apparatus components related to a shelf and drawer assemblies for storing bottles. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1A. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring now to FIG. 1A, a refrigerated appliance 10 is shown having a cabinet 12 defining a storage compartment 14. A door 16 is coupled to the cabinet 12 and configured to pivot between open and closed positions to selectively provide access to the storage compartment 14. The door 16 includes a centrally disposed glass panel 18 that allows for viewing of the storage compartment 14 when the door 16 is in the closed position shown in FIG. 1A. A liner 20 generally defines the parameters of the storage compartment 14 and includes first and second sidewalls 22, 24 that are interconnected by a top wall 26 and a bottom wall 28. In the embodiment of FIG. 1A, a plurality of shelves 29 is positioned within the storage compartment 14 and is comprised of six shelf assemblies 30. Other numbers of shelf assemblies may be incorporated into an overall layout of the storage compartment 14 without departing from the spirit of the present concept. The refrigerated appliance 10 shown in FIG. 1A is a compact refrigerator or wine refrigerator disposed in an under-counter configuration and designed to hold a number of bottles 31 on the plurality of shelves 29. However, the shelf assemblies 30 of the present concept are contemplated for use in any type of refrigerated appliance or general storage compartment. The shelf assemblies 30 are configured to slide between stowed and extended positions along the path indicated by arrow 32. In FIG. 1A, the shelf assemblies 30 are shown in the stowed or retracted position, wherein the entirety of the shelf assemblies 30 are received within the storage compartment 14 of the cabinet 12.

Figure 1B:
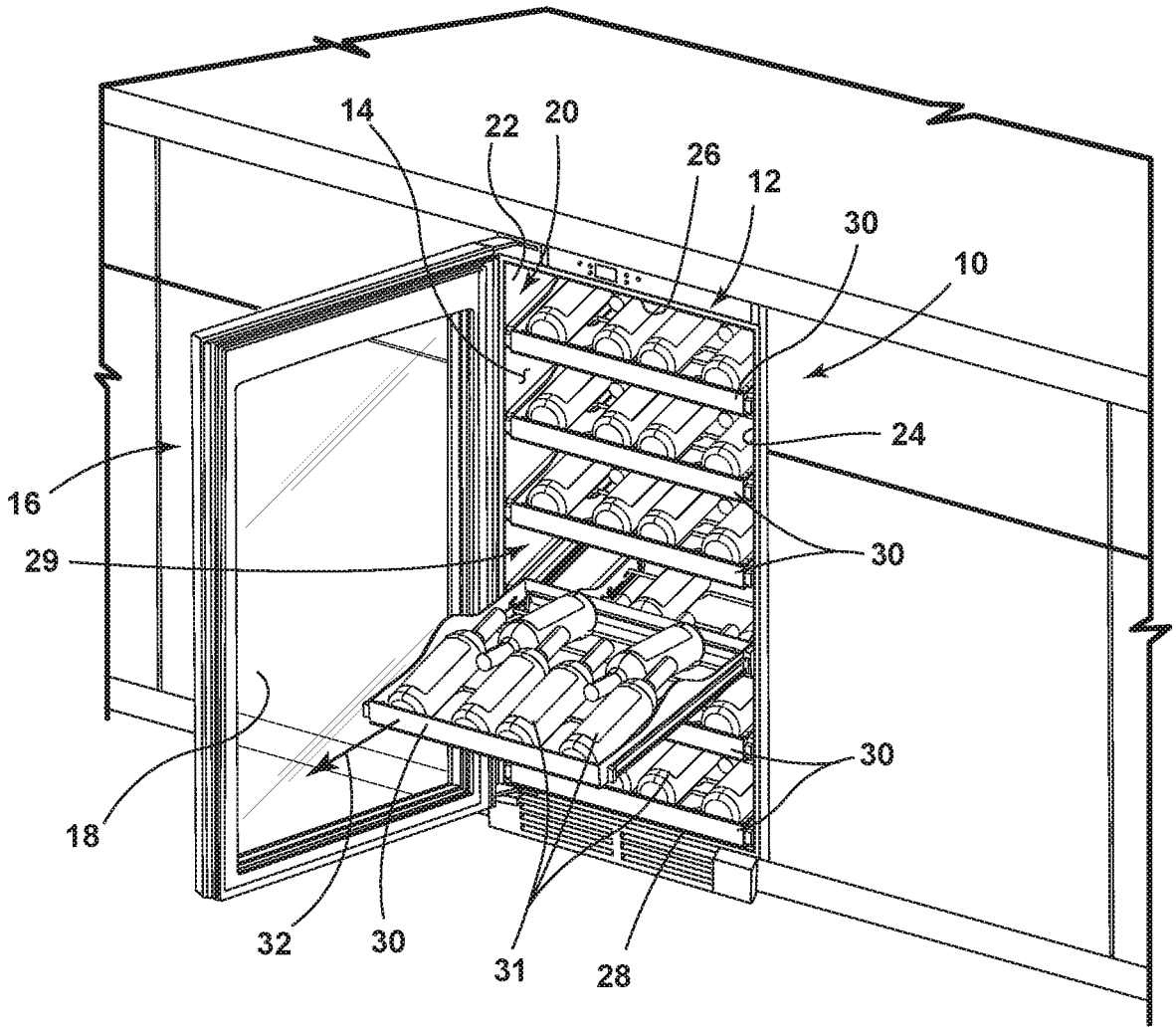
FIG. 1B is a top perspective view of the refrigerated appliance of FIG. 1 showing a shelf assembly of the plurality of shelf assemblies in an extended position.

Referring now to FIG. 1B, a shelf assembly 30 of the plurality of shelves 29 is shown in the extended position, wherein the extended shelf assembly 30 is configured to move the bottles 31 to a display position. Thus, in the present concept, the bottles 31 stored on the shelf assemblies 30 will move from a horizontal stored position to an upwardly angled display position as the shelf assemblies 30 are moved from the stowed or retracted position to the extended position.

Figure 2:
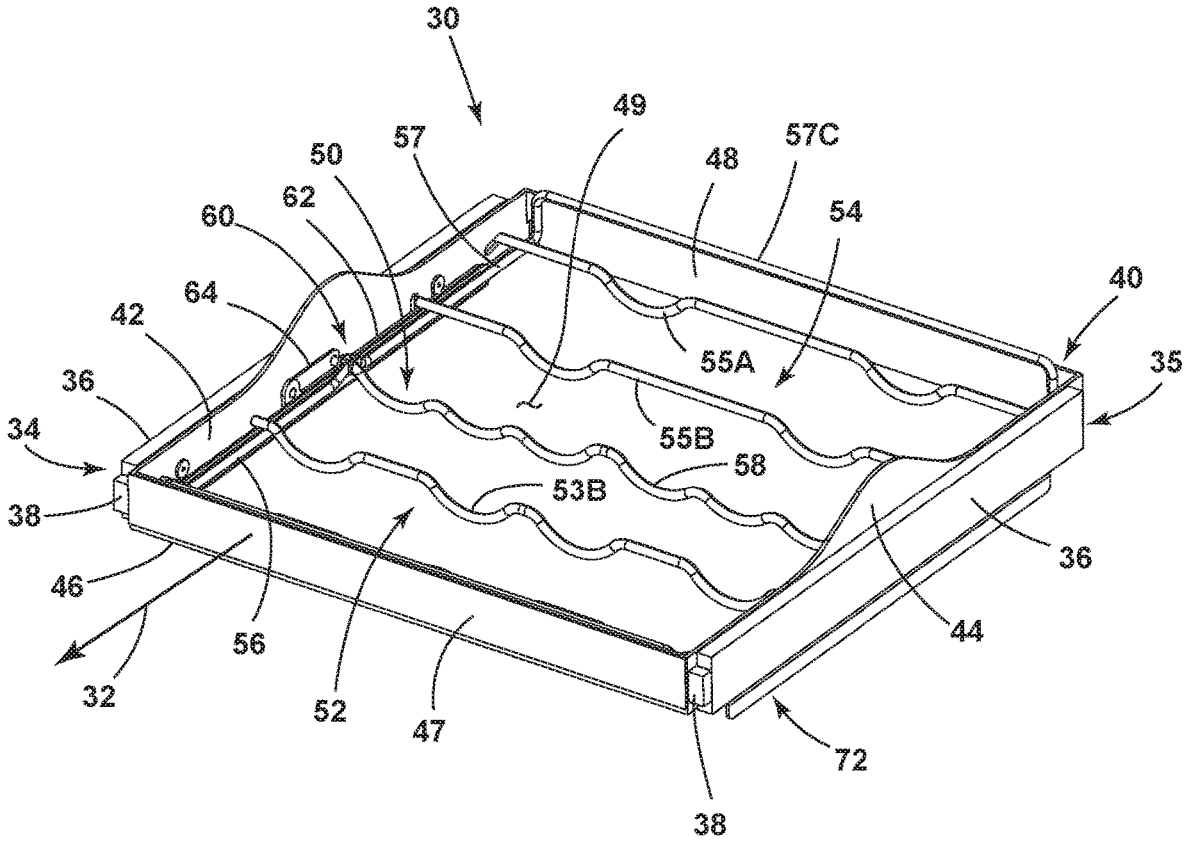
FIG. 2 is a top perspective view of a shelf assembly having a frame assembly in a stowed position with a rack assembly coupled thereto in a first position.

Referring now to FIG. 2, a single shelf assembly 30 is shown as removed from the storage compartment 14 of the cabinet 12 of the refrigerated appliance 10. The shelf assembly 30 includes a frame assembly 40 having first and second side members 42, 44, and front and rear frame members 46, 48 that interconnect the first and second side members 42, 44. The first and second side members 42, 44 are spaced-apart from one another or otherwise opposed to one another. Similarly, the front and rear frame members 46, 48 are spaced-apart from one another or otherwise opposed to one another. In this way, first and second side members 42, 44 and the front and rear frame members 46, 48 of the frame assembly 40 cooperate to define a centrally disposed window 49. The front frame member 46 may include a trim band 47 coupled thereto, such as a wood or metal accent trim piece, to provide a pleasing aesthetic to the plurality of shelf assemblies 29 (FIG. 1) as received within the refrigerated appliance 10.

As further shown in FIG. 2, the frame assembly 40 is operably coupled to opposed slide assemblies 34, 35 at the first and second side members 42, 44, respectively, of the frame assembly 40. The slide assemblies 34, 35 each include a cabinet member 36 and a shelf member 38. In assembly, the cabinet member 36 is fixedly coupled to a cabinet, such as cabinet 12 shown in FIGS. 1A and 1B. Specifically, the cabinet member 36 of the slide assemblies 34, 35 may be coupled to the liner 20 of the refrigerated appliance 10 at one of the sidewalls 22, 24 thereof. The shelf member 38 is slidably received by the cabinet member 36 between extended and retracted positions, and is fixedly coupled to the shelf assembly 30 at one of the first and second side members 42, 44 of the frame assembly 40. Thus, in the embodiment shown in FIG. 2, the first and second side members 42, 44 of the frame assembly 40 each include a shelf member 38 coupled thereto which is received in a respective cabinet member 36 of the opposed slide assemblies 34, 35. In this way, the shelf assembly 30 is displaceably received within the cabinet 12 (FIGS. 1A and 1B) between the extended and stowed positions.

As further shown in FIG. 2, the shelf assembly 30 includes a rack assembly 50 having a front rack 52 and a rear rack 54 which are hingedly coupled to one another. The front and rear racks 52, 54 may also be referred to herein as first and second racks that are pivotally coupled to one another to define the rack assembly 50. In this way, the front rack 52 and the rear rack 54 can pivot with respect to one another, thereby making the rack assembly 50 a hinged rack assembly. The front rack 52 and the rear rack 54 are pivotally coupled to the first and second side members 42, 44 of the frame assembly 40, as further described below, with specific reference to FIG. 5.

Figure 3:
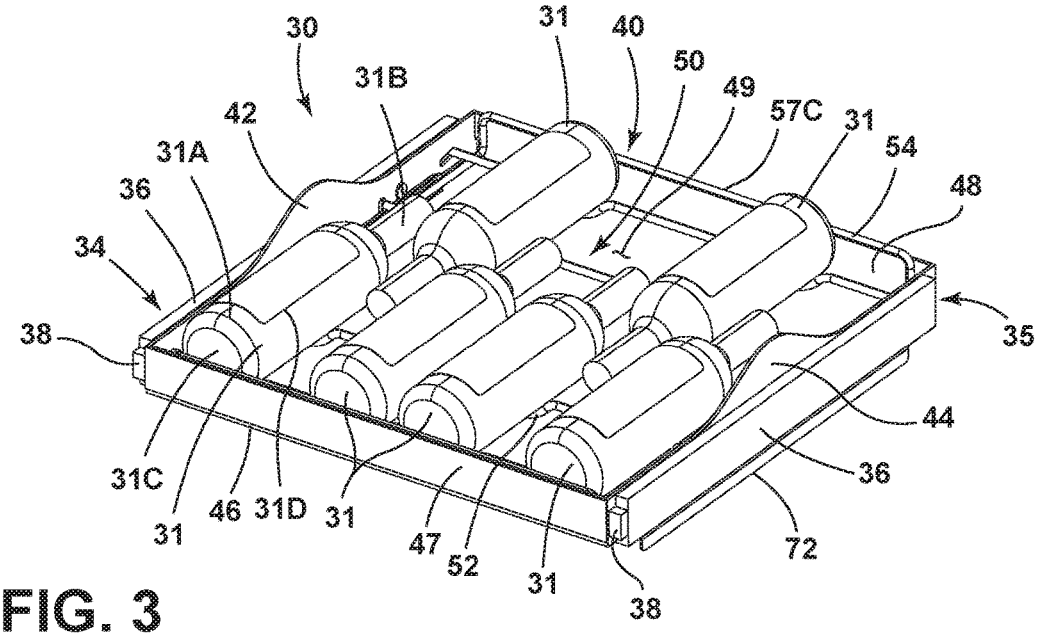
FIG. 3 is a top perspective view of the shelf assembly of FIG. 2 having a plurality of bottles supported on the rack assembly.
Figure 5:
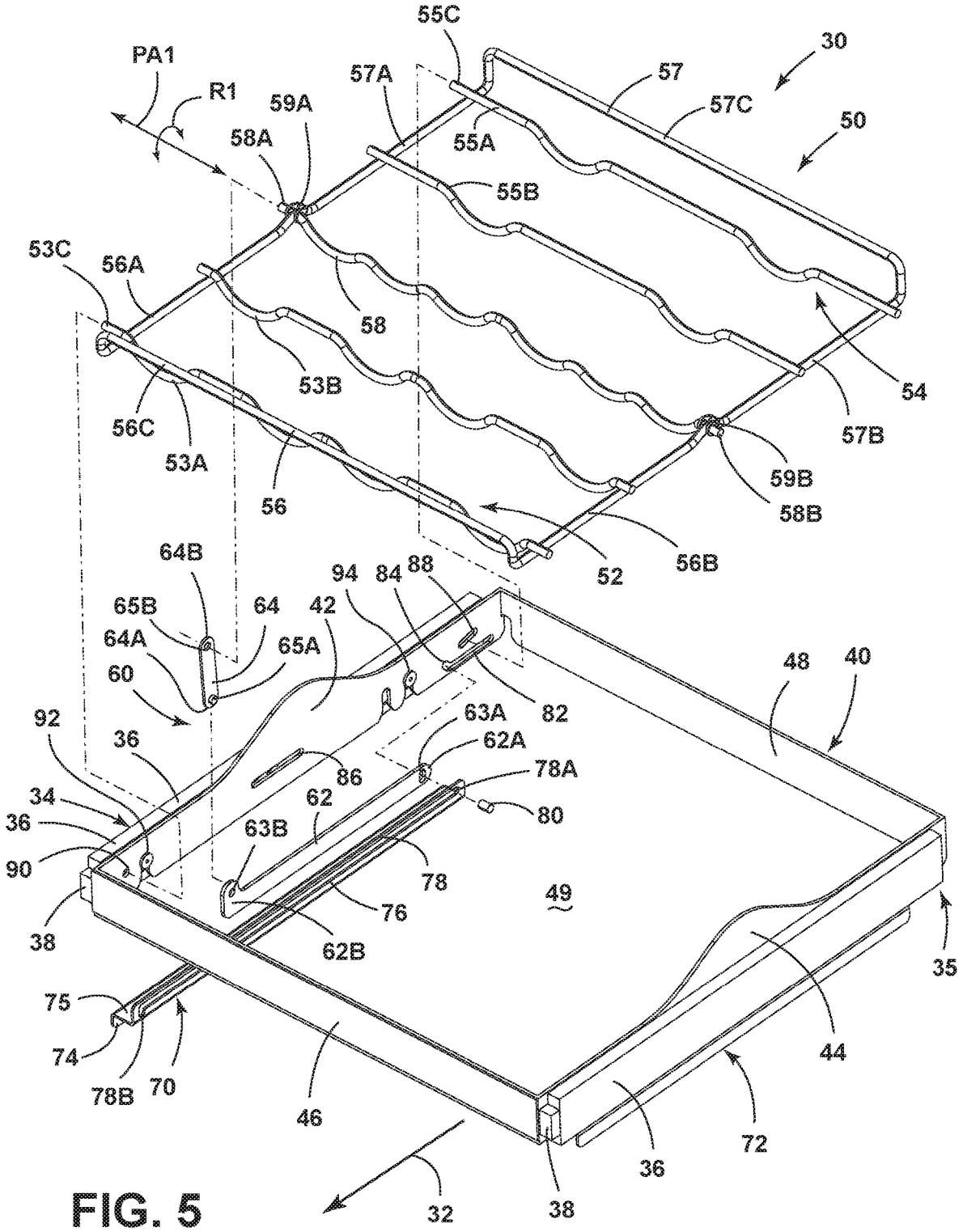
FIG. 5 is an exploded top perspective view of the shelf assembly of FIG. 2.

Referring now to FIG. 5, the front rack 52 includes a frame member 56 that has a generally U-shaped configuration with multiple support members 53A, 53B and 58 interconnecting spaced-apart legs 56A, 56B of the frame member 56. As shown in FIG. 5, the support members 53A, 53B and 58 include undulations configured to cradle and receive various portions of the bottles 31, as best shown in FIG. 3. Similarly, the rear rack 54 includes a frame member 57 that has a generally U-shaped configuration with multiple support members 55A, 55B interconnecting spaced-apart legs 57A, 57B (FIG. 5) of the frame member 57. As shown in FIG. 5, the support members 55A, 55B include undulations configured to cradle and received various portions of the bottles 31, as best shown in FIG. 3. The front rack 52 is hingedly coupled to the rear rack 54 at opposed collar assemblies 59A, 59B. Specifically, the collar assemblies 59A, 59B are contemplated to be connected to the ends of legs 57A, 57B of the frame member 57 of the rear rack 54, and pivotally coupled to the support member 58 of the front rack 52. In this way, the rear rack 54 can pivot with respect to the front rack 52, and vice versa, along a pivot axis PAL As further shown in FIG. 5, the frame members 56, 57 each include raised end portions 56C, 57C which interconnect the respective spaced-apart legs 56A, 56B and 57A, 57B thereof, and act as stop engagement members for bottom portions of the bottles 31.

Referring again to FIG. 5, the shelf assembly 30 further includes a linkage assembly 60 having first and second arms 62, 64. The first arm 62 is slidably coupled to the frame assembly 40 at the first side member 42. The second arm 64 is rotatably coupled to the first arm 62 and is further coupled to the rack assembly 50. In this way, the linkage assembly 60 is configured to move the rack assembly 50 between a first position associated with the horizontal storage of the bottles 31 (FIG. 3) within the cabinet 12 (FIG. 1A), and a second position associated with the angled display position of the bottles 31 (FIG. 4) as extended outwardly from the cabinet 12 (FIG. 1B). In assembly, the linkage assembly 60 interconnects the rack assembly 50 and the frame assembly 40.

Referring now to FIG. 3, the shelf assembly 30 is shown having bottles 31 received on the rack assembly 50. In the embodiment shown in FIG. 3, four bottles 31 are supported on the front rack 52 of the rack assembly 50 in a first direction, while two bottles 31 are supported on the rear rack 54 of the rack assembly 50 in a second direction that is opposed to the first direction. With particular reference to the bottle 31 shown on the left side of the front rack 52, the bottle 31 includes a body portion 31A having a narrowed neck portion 31B and a bottom portion 31C disposed on opposite sides of the body portion 31A. A label 31D is shown positioned on the body portion 31A. The different portions of the bottle 31 described above also describes the other bottles 31 supported on the rack assembly 50. Thus, the various undulations of the support members 53A, 53B, 55A, 55B and 58 (FIG. 5) of the rack assembly 50 are sized appropriately to support both the body portion 31A and the neck portion 31B of the bottles 31. The raised end portions 56C, 57C of the front and rear racks 52, 54 are configured to engage the bottom portions 31C of the bottles 31 as stored on the rack assembly 50. In FIG. 3, the shelf assembly 30 is shown in a stowed position. Therefore, the frame assembly 40 thereof is also configured in a stowed position. In the stowed position of the frame assembly 40, the rack assembly 50 supports the bottles 31 in a horizontal storage configuration that helps to minimize the amount of space the shelf assembly 30 occupies within a storage compartment, such as storage compartment 14 of the refrigerated appliance 10 shown in FIG. 1A.

Figure 4:
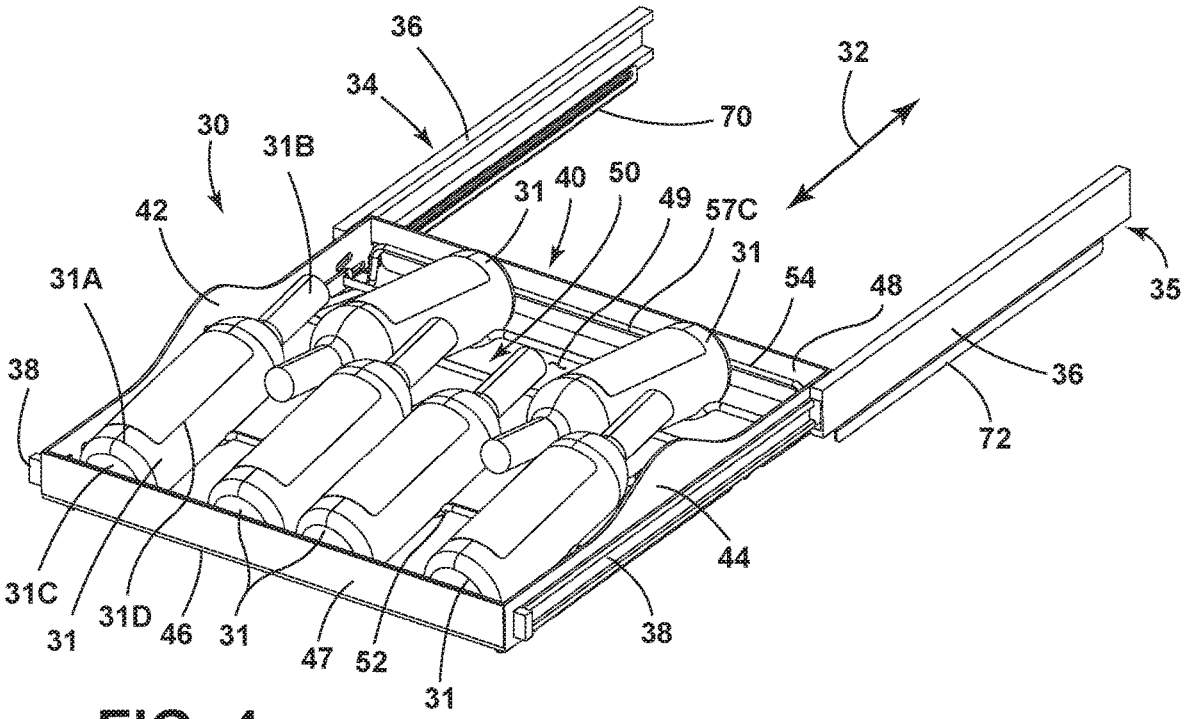
FIG. 4 is a top perspective view of the shelf assembly of FIG. 3 with the frame assembly in an extended position and a rack assembly in a second position.

Referring now to FIG. 4, the shelf assembly 30 is shown in an extended position.

Therefore, the frame assembly 40 thereof is also configured in an extended position. In the extended position of the frame assembly 40, the rack assembly 50 supports the bottles 31 in an angled presentation or display configuration that presents the bottles 31 to a user. In the angled display configuration, the labels 31D of the bottles 31 are easier to read. Thus, the frame assembly 40 is movable between stowed and extended positions (FIGS. 3 and 4), as operably coupled to the slide assemblies 34, 35. Specifically, the first and second side members 42, 44 of the frame assembly 40 are fixedly coupled to the shelf members 38 of the respective slide assemblies 34, 35 by fasteners, such as fasteners 92, 94 securing shelf member 38 to the first side member 42 of frame assembly 40, as best shown in FIG. 5.

As shown in FIG. 3 and FIG. 4, the rack assembly 50 is operable between first and second positions, which respectively relate to the horizontal storage position and the upwardly angled display position of the bottles 31. The rack assembly 50 is driven from the first position to the second position as the frame assembly 40 moves from the stowed position to the extended position, as further described below. The second position of the rack assembly 50 may be referred to as a raised position in which the front rack 52 and the rear rack 54 are angled towards one another. Specifically, the front rack 52 and the rear rack 54 are angled towards a pivot axis PA1 (FIG. 5) defined by centrally disposed support member 58 when the rack assembly 50 is in the second position, as further described below.

Referring now to FIG. 5, the rack assembly 50 is shown exploded away from the central window 49 of the frame assembly 40. As noted above, the front rack 52 is hingedly coupled to the rear rack 54 at opposed collar assemblies 59A, 59B that interconnect the ends of legs 57A, 57B of the frame member 57 of the rear rack 54 to the centrally disposed support member 58 of the front rack 52. In this way, the rear rack 54 can pivot with respect to the front rack 52, and vice versa, along the pivot axis PA1 defined by the centrally disposed support member 58 in the rotational direction as indicated by arrow R1 as the rack assembly 50 moves between the first and second positions. It is contemplated that the centrally disposed support member 58, which is pivotally coupled to the linkage assembly 60 and defines the pivot axis PA1 of the rack assembly 50, may be a part of the front rack 52 or the rear rack 54. In the embodiment shown in FIG. 5, the centrally disposed support member 58 is provided as part of the front rack 52.

As further shown in FIG. 5, the linkage assembly 60 is shown exploded away from the frame assembly 40 and the rack assembly 50. The first arm 62 of the linkage assembly 60 includes a first end 62A having a mounting aperture 63A. The first arm 62 of the linkage assembly 60 further includes a second end 62B having a receiving aperture 63B. The second arm 64 of the linkage assembly 60 includes a first end 64A having a mounting pin 65A. The mounting pin 65A of the second arm 64 of the linkage assembly 60 is configured to be received in the receiving aperture 63B of the second end 62B of the first arm 62 of the linkage assembly 60. In this way, the second arm 64 of the linkage assembly 60 is pivotally coupled to the first arm 62 of the linkage assembly 60 at the first end 64A of the second arm 64 and at the second end 62B of the first arm 62. This pivoting coupling provides for movement of the second arm 64 between raised and lowered positions with respect to the first arm 62 of the linkage assembly 60. The second arm 64 of the linkage assembly 60 further includes a second end 64B having a receiving aperture 65B disposed therethrough for coupling to the rack assembly 50, as further described below.

As further shown in FIG. 5, a rail member 70 is exploded away from the frame assembly 40, the linkage assembly 60 and the slide assembly 34. The rail member 70 includes a mounting portion 74 which is a generally upright portion used to fixedly mount the rail member 70 to the liner 20 of the refrigerated appliance 10 at one of the sidewalls 22, 24 thereof. In the configuration shown in FIG. 5, the rail member 70 would be fixedly coupled to the first sidewall 22 of the liner 20 of the refrigerated appliance 10. The rail member 70 further includes an intermediate portion 75 which inwardly extends from the mounting portion 74. The rail member 70 further includes an inner portion 76 that upwardly extends from the intermediate portion 75 and includes an elongate slot 78 disposed therethrough. The elongate slot 78 includes a first end 78A and a second end 78B. The second end 78B defines a downwardly turned end portion of the elongate slot 78. The mounting aperture 63A of the first arm 62 of the linkage assembly 60 is configured to receive a guide pin 80 that is also slideably coupled to the elongate slot 78 of the rail member 70. Thus, the guide pin 80 is configured to move along the elongate slot 78 of the rail member 70 from the first end 78A to the downwardly turned second end 78B of the elongate slot 78 as the frame assembly 40 moves from the stowed position to the extended position. In assembly, the rail member 70 is configured to be disposed below the slide assembly 34, as shown in FIG. 4. In FIGS. 2-4, a second rail member 72 is shown associated with slide assembly 35. The second rail member 72 includes a similar shape relative to the rail member 70 described above, but in a mirrored configuration. Thus, the frame assembly 40 is operably coupled to the rail member 70 via the first arm 62 of the linkage assembly 60 which is operably coupled to both the first and second slots 82, 86 of first side member 42 of the frame assembly 40. In this way, the frame assembly 40 is displaceably associated with the rail member 70 as the frame assembly 40 moves between the stowed and extended positions (FIGS. 1A and 1B) relative to the rail member 70 that is fixedly coupled to the cabinet 12 of the refrigerated appliance 10 in assembly.

As further shown in FIG. 5, the first arm 62 of the linkage assembly 60 is slidably coupled to the first side member 42 of the frame assembly 40 at first and second slots 82, 86 disposed through the first side member 42. Specifically, the guide pin 80 that is received in the mounting aperture 63A of the first arm 62 of the linkage assembly 60 is also slideably received in the first slot 82 of the first side member 42 of the frame assembly 40. The first slot 82 includes a downwardly angled end portion 84. As noted above, the guide pin 80 is also slidably received in the elongate slot 78 of the rail member 70. Similarly, the mounting pin 65A is pivotally coupled to the receiving aperture 63B of the first arm 62 of the linkage assembly 60, and is slideably received in the second slot 86 of the first side member 42 of the frame assembly 40. As noted above, the mounting pin 65A also rotatably couples the second arm 64 to the first arm 62 of the linkage assembly 60. Thus, the first end 62A of the first arm 62 of the linkage assembly 60 is slideably coupled with the first slot 82 of the first side member 42, and the second end 62B of the first arm 62 of the linkage assembly 60 is slideably coupled to the second slot 86 of the first side member 42. The first end 62A of the first arm 62 of the linkage assembly 60 is also slideably coupled with the elongate slot 78 of the rail member 70 via guide pin 80. The first side member 42 of the frame assembly 40 further includes a third slot 88 that is downwardly angled and disposed through the first side member 42. In assembly, an end portion 55C of support member 55A of the rear rack 54 of the rack assembly 50 is pivotally and slidably received within the third slot 88 of the first side member 42. An end portion 53C of the support member 53A of the front rack 52 of the rack assembly 50 is pivotally received within a receiving aperture 90 disposed through the first side member 42. In this way, front rack 52 and the rear rack 54 of the rack assembly 50 are pivotally coupled to the first side member 42 of the frame assembly 40 for movement of the rack assembly 50 between the first and second positions. An end portion 58A of the centrally disposed support member 58 is received in the receiving aperture 65B of the second arm 64 of the linkage assembly. The pivot axis PA1 defined between the front rack 52 and the rear rack 54 is defined by the end portion 58A of the centrally disposed support member 58 at the coupling between the linkage assembly 60 at receiving aperture 65B of the second arm 64 and the end portion 58A of the centrally disposed support member 58 of the rack assembly 50.

Figure 6A:
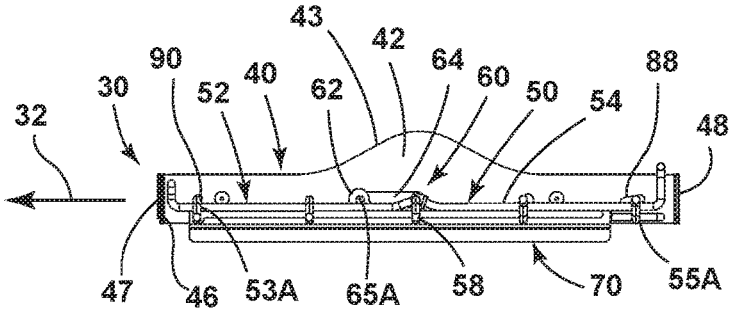
FIGS. 6A-6D are cross-sectional side elevation views of the shelf assembly of FIG. 2 showing relative movement of the frame assembly from the stowed position to the extended position and relative movement of the rack assembly from the first position to the second position.
Figure 6B:
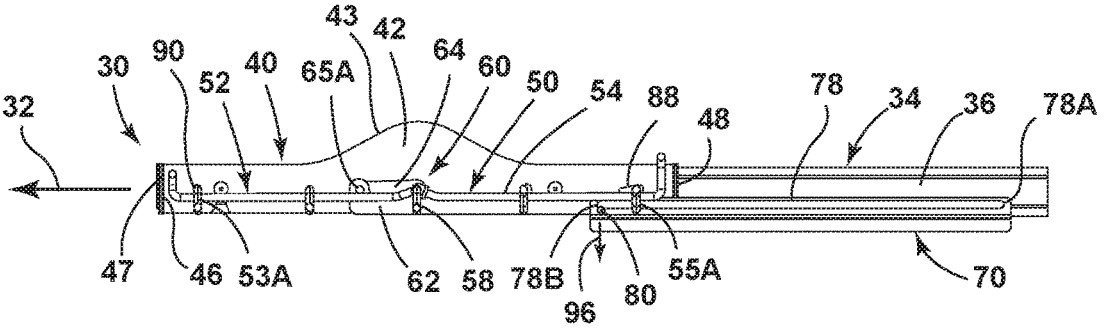
Figure 6C:
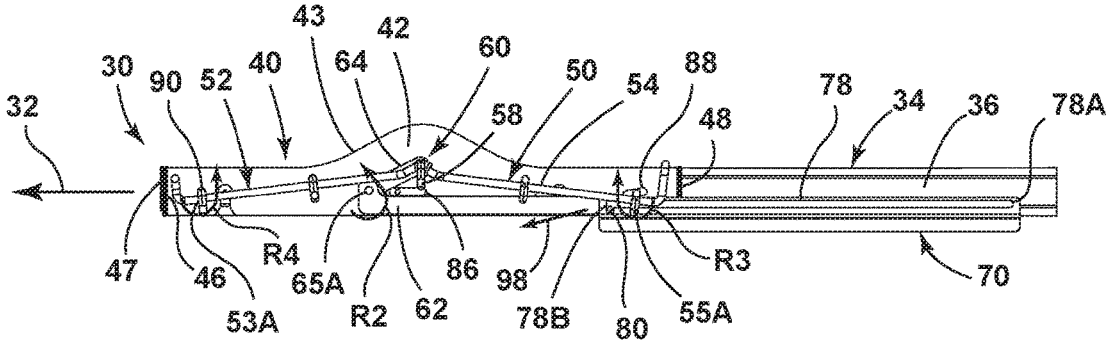
Figure 6D:
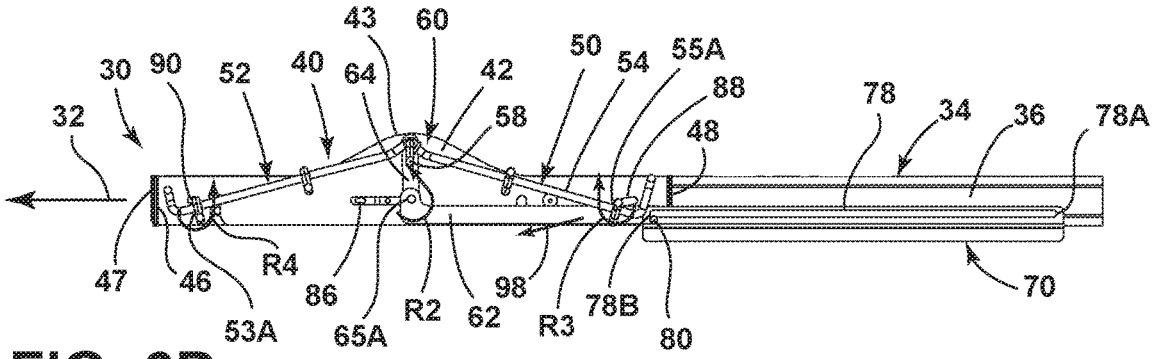

Referring now to FIG. 6A, the shelf assembly 30 is shown with the frame assembly 40 in the stowed position. With the frame assembly 40 in the stowed position, the rack assembly 50 is in the first position configured for horizontal storage of bottles as described above with reference to FIG. 2. As shown in FIG. 6B, the rack assembly 50 remains in the first position as the frame assembly 40 begins its initial outward movement towards the extended position from the stowed position along the path indicated by arrow 32. In FIG. 6B, the guide pin 80 has moved from the first end 78A of the elongate slot 78 of the rail member 70 to the second end 78B of the elongate slot 78. As noted above, the second end 78B of the elongate slot 78 defines a downwardly turned end portion of the elongate slot 78. Thus, when the guide pin 80 aligns with the downwardly turned end portion 78B of the elongate slot 78, the guide pin 80 drops down in the direction indicated by arrow 96 and nests in the downwardly turned second end 78B of the elongate slot 78 as shown in FIGS. 6B-6D. This engagement between the guide pin 80 and the downwardly turned second end 78B of the elongate slot 78 of the rail member 70 stops the movement of the linkage assembly 60 relative to the rail member 70. As noted above, the first arm 62 is coupled to the frame assembly 40 at the first and second slots 82, 86 thereof. Thus, the frame assembly 40 continues its outward movement towards the fully extended position along the path indicated by arrow 32 even after the linkage assembly 60 ceases its outward movement.

As the frame assembly 40 continues its outward movement towards the fully extended position along the path indicated by arrow 32, the first arm 62 of the linkage assembly 60 will not extend out any further, but will accommodate the further outward movement of the frame assembly 40 by the guide pin 80 and the mounting pin 65A being operably coupled to the first arm 62 of the linkage assembly 60 and the first and second slots 82, 86 of the first side member 42 of the frame assembly 40. Thus, as the frame assembly 40 continues its outward movement towards the fully extended position along the path indicated by arrow 32 and the first arm 62 of the linkage assembly 60 is held in place by guide pin 80, the second arm 64 of the linkage assembly 60 will start to rotate along the path indicated by arrow R2 from a lowered position (FIGS. 6A, 6B) towards a raised position (FIG. 6D). The rotating movement of the second arm 64 of the linkage assembly 60 in the direction indicted by arrow R2 is shown in FIG. 6C at mounting pin 65A.

With further reference to FIG. 6C, the front and rear racks 52, 54 of the rack assembly 50 begin lifting upward towards the second position of the rack assembly 50 with the rising movement of the second arm 64 of the linkage assembly 60. This is due to the coupling between the second arm 64 of the linkage assembly 60 and the centrally disposed support member 58 of the rack assembly 50. Thus, the second arm 64 of the linkage assembly 60 moves from the lowered position (FIG. 6A, 6B) to the raised position (FIG. 6D) as the frame assembly 40 moves from the stowed position (FIG. 6A) to the extended position (FIG. 6D). To accommodate this upward movement of the rack assembly 50 from the first position (FIG. 6A) to the second position (FIG. 6D), the support member 55A of the rear rack 54 moves downwardly in the direction as indicated by arrow 98 along the third slot 88 that is downwardly angled along the first side member 42 of the frame assembly 40. The rear rack 54 also pivots in the direction as indicated by arrow R3 at the interconnection between the support member 55A of the rear rack 54 as received within the third slot 88. Similarly, the front rack 52 also pivots in the direction as indicated by arrow R4 at the interconnection between the support member 53A of the front rack 52 and receiving aperture 90 of the first side member 42 of the frame assembly 40. Thus, at the respective support members 53A, 55A thereof, the front and rear racks 52, 54 of the rack assembly 50 pivot in opposite directions (R3, R4) with respect to the first side member 42 of the frame assembly 40. The front and rear racks 52, 54 of the rack assembly 50 further pivot with respect to one another along the direction as indicated by arrow R1 at the pivot axis PA1 of the rack assembly 50, as best shown in FIG. 7.

Referring now to FIG. 6D, the rack assembly 50 is shown in a raised second position with the second arm 64 of the linkage assembly 60 shown having been rotated to a raised position. Thus, the second arm 64 of the linkage assembly 60 is operable between raised and lowered positions to lift the front and rear racks 52, 54 of the rack assembly 50 to provide inclined or angled support for bottles stored on the rack assembly 50. The support member 55A of the rear rack 54 is shown as having reached the end of the third slot 88 of the first side member 42 of the frame assembly 40. As further shown in FIGS. 6A-6D, the first side member 42 of the frame assembly 40 includes an upwardly extending ridge 43 that guards the movement of the rack assembly 50 and linkage assembly 60 from interference with any adjacent features.

Figure 7:
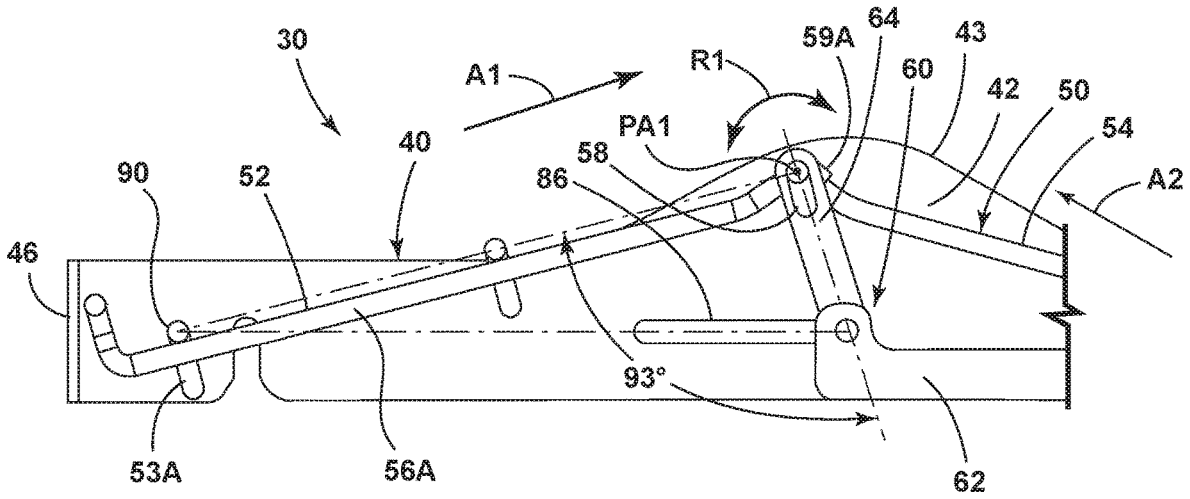
FIG. 7 is a fragmentary side elevation view of the rack assembly of FIG. 6D in a locked position.

Referring now to FIG. 7, the rack assembly 50 is shown in a locked position that is provided by an over-rotation of the second arm 64 of the linkage assembly 60. Specifically, the second arm 64 of the linkage assembly 60 has rotated to a point in FIG. 7, where the angle between the leg 56A of the front rack 52 is over 90° relative to the second arm 64 of the linkage assembly 60. In FIG. 7, the angle between the leg 56A of the front rack 52 and the second arm 64 of the linkage assembly 60 is contemplated to be about 93°. In this way, the rack assembly 50 and linkage assembly 60 provide a lock feature, wherein the rack assembly 50 will not collapse from the raised second position to the flat first position under the weight of the rack assembly 50 itself, or the weight of the bottles stored thereon. Moving the rack assembly 50 to the first position from the second position requires a user to push the frame assembly 40 inwardly towards the stowed position to overcome the locking effect. Further, as shown in FIG. 7, the front rack 52 and the rear rack 54 are angled towards the pivot axis PA1 defined between the front rack 52 and the rear rack 54 when the second arm 64 is in the raised position. Angles of the front rack 52 and the rear rack 54 of the rack assembly 50 are shown in FIG. 7 as arrows A1 and A2, respectively.

While the linkage assembly 60 has been shown as being coupled to the first side member 42 of the frame assembly 40, it is contemplated that a second linkage assembly may be coupled to the second side member 44 of the frame assembly 40 and operate in a similar manner as linkage assembly 60. Thus, the rack assembly 50 may include dual linkage assemblies attached to the opposed first and second side members 42, 44 of the frame assembly 40 and engaged with first and second rail members 70, 72, respectively.

Figure 8:
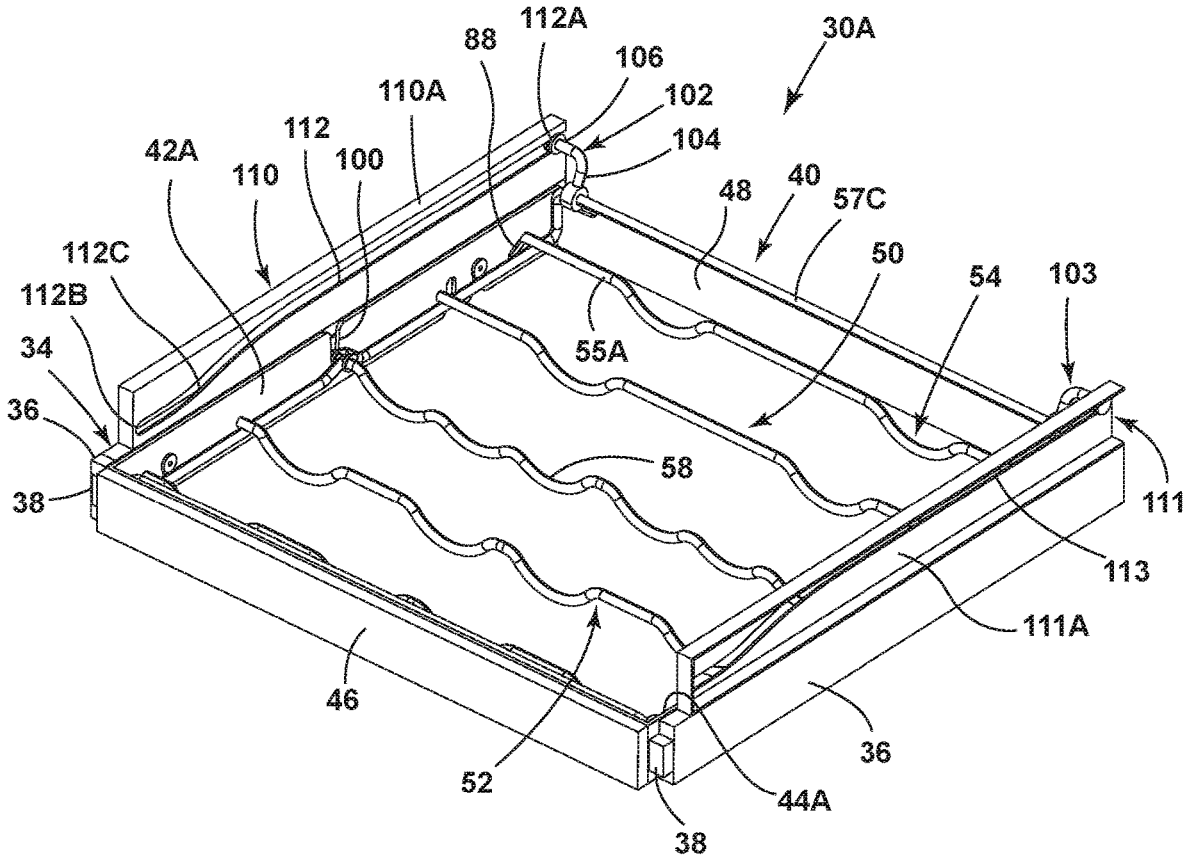
FIG. 8 is a top perspective view of a shelf assembly according to an embodiment having a frame assembly in a stowed position with a rack assembly coupled thereto in a first position.

Referring now to FIG. 8, another embodiment of a shelf assembly 30A is shown that includes numerous features that are the same or similar to shelf assembly 30 described above with reference to FIGS. 1A-7. As such, like reference numerals used in the description of shelf assembly 30 will also be used to describe the same or similar features of shelf assembly 30A, unless indicated otherwise. As shown in FIG. 8, the shelf assembly 30A includes a frame assembly 40 having a rack assembly 50 disposed therein. The frame assembly 40 includes first and second side members 42A, 44A that are similar to the first and second side members 42, 44 of the frame assembly 40 described above. The first side member 42A includes an upwardly opening slot 100 in which the end portion 58A (FIG. 11) is received when the rack assembly 50 is in the first position for horizontal storage of bottles thereon. The first side member 42A further includes slot 88 for slideably and pivotally coupling the rear rack 54 to the first side member 42A, in a similar manner as described above with reference to shelf assembly 30. The first side member 42A further includes receiving aperture 90 (FIG. 11) for pivotally coupling the front rack 52 to the first side member 42A, in a similar manner as described above with reference to shelf assembly 30. As further shown in FIG. 8, the end portion 57C of the rear rack 54 of the rack assembly 50 includes a guide pin 102 operably coupled to the rack assembly 50 and outwardly extending therefrom. Specifically, the guide pin 102 includes an upwardly extending first portion 104 and an outwardly extending second portion 106. The guide pin 102 is operably coupled to a guide member 110 that is disposed above slide assembly 34 and is contemplated to be fixedly coupled to the liner 20 (FIG. 1A) of the refrigerated appliance 10 at one of the first or second sidewalls 22, 24 thereof. The guide member 110 includes a body portion 110A having an elongate slot 112 disposed therethrough. The elongate slot 112 is configured to receive a portion of the guide pin 102 for sliding movement of the guide pin 102 along the length of the elongate slot 112. The elongate slot 112 includes first and second ends 112A, 112B. The guide pin 102 moves from a first end 112A of the elongate slot 112 to the second end 112B of the elongate slot 112 as the frame assembly 40 moves from the stowed position to the extended position, as further described below. The first and second ends 112A, 112B of the elongate slot 112 of the guide member 110 are vertically offset from one another, in that the first end 112A of the elongate slot 112 is positioned vertically above the second end 112B of the elongate slot 112. Accordingly, the elongate slot 112 includes an angled portion 112C disposed between the first and second ends 112A, 112B. The angled portion 112C is angled downwards as the guide pin 102 travels from the first end 112A to the second end 112B, and is angled upward as the guide pin 102 travels from the second end 112B to the first end 112A. In the embodiment shown in FIG. 8, a second guide pin 103 is shown coupled to an elongate slot 113 disposed through a body portion 111A of a second guide member 111 that is positioned above the second slide assembly 35. Thus, it is contemplated that the shelf assembly 30A may include dual guide pins 102, 103 and opposed dual guide members 110, 111 acting in concert with one another, in a mirrored manner, to effectuate movement of the rack assembly 50 between first and second positions.

Figure 9:
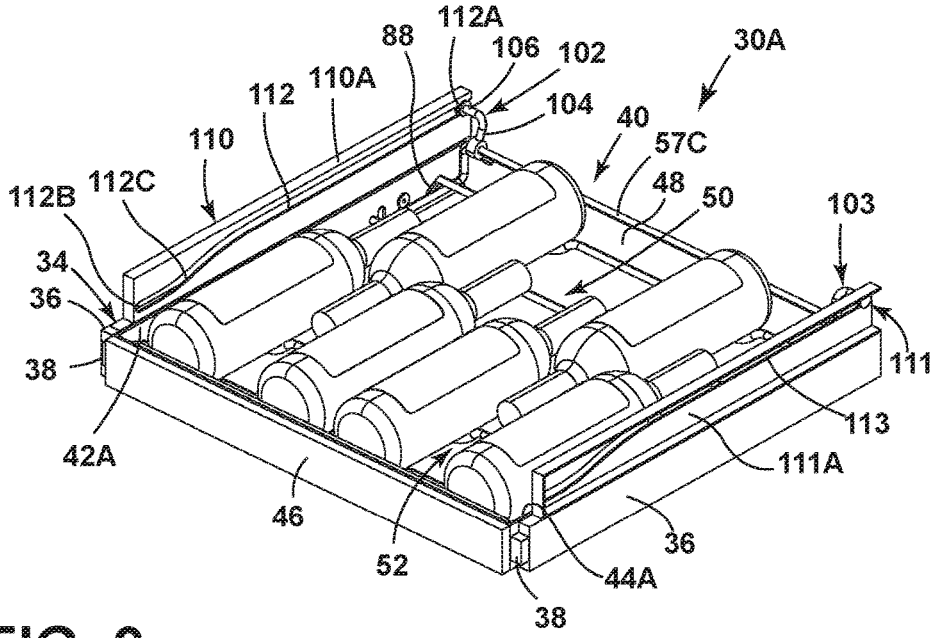
FIG. 9 is a top perspective view of the shelf assembly of FIG. 8 having a plurality of bottles supported on the rack assembly.

Referring now to FIG. 9, the shelf assembly 30A is shown having bottles 31 received on the rack assembly 50. In FIG. 9, the shelf assembly 30A is shown in a stowed position. Therefore, the frame assembly 40 thereof is also configured in a stowed position. In the stowed position of the frame assembly 40, the rack assembly 50 supports the bottles 31 in a horizontal storage configuration that helps to minimize the amount of space the shelf assembly 30A occupies within a storage compartment.

Figure 10:
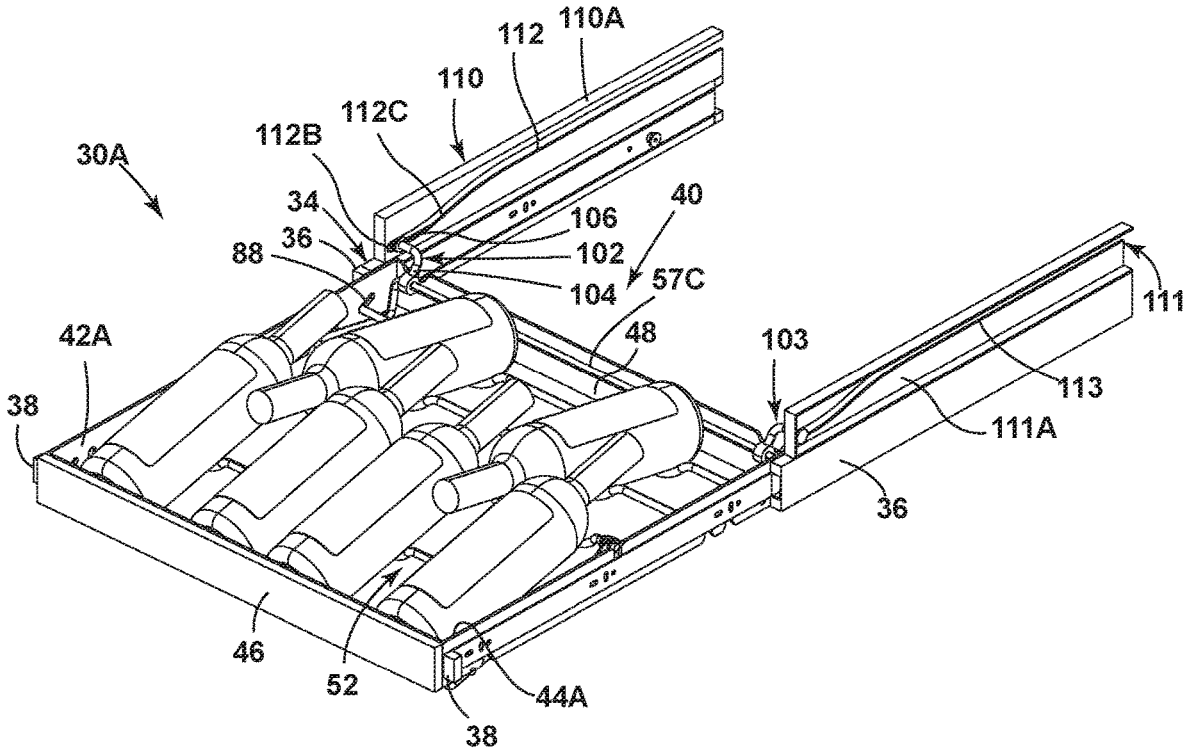
FIG. 10 is a top perspective view of the shelf assembly of FIG. 9 with the frame assembly in an extended position and a rack assembly in a second position.

Referring now to FIG. 10, the shelf assembly 30A is shown in an extended position. Therefore, the frame assembly 40 thereof is also configured in an extended position. In the extended position of the frame assembly 40, the rack assembly 50 supports the bottles 31 in an angled presentation or display configuration that presents the bottles 31 to a user.

As shown in FIG. 9 and FIG. 10, the rack assembly 50 is operable between first and second positions, which respectively relate to the horizontal storage position and the upwardly angled display position of the bottles 31. The rack assembly 50 moves, or is driven, from the first position to the second position as the frame assembly 40 moves from the stowed position to the extended position, as further described below. The second position of the rack assembly 50 may be referred to as a raised position in which the front rack 52 and the rear rack 54 are angled towards one another. Specifically, the front rack 52 and the rear rack 54 of the rack assembly 50 are angled towards a pivot axis PA1 (FIG. 11) defined by centrally disposed support member 58 when the rack assembly 50 is in the second position, in a similar manner as described above. As specifically shown in FIG. 10, the guide pin 102 has moved from the first end 112A of the elongate slot 112 of the guide member 110 to the second end 112B of the elongate slot 112 of the guide member 110. Thus, the guide pin 102 has moved downward along its travel between the first end 112A and the second end 112B of the elongate slot 112. This downward movement of the guide pin 102 pushes the rear rack 54 downward at the end portion 57C thereof. The first side member 42A of the frame assembly 40 remains vertically static, such that the downward movement of the rack assembly 50 via the interaction between the guide pin 102 and the guide member 110 causes the rack assembly 50 to move to the second position, as further described below.

Figure 11:
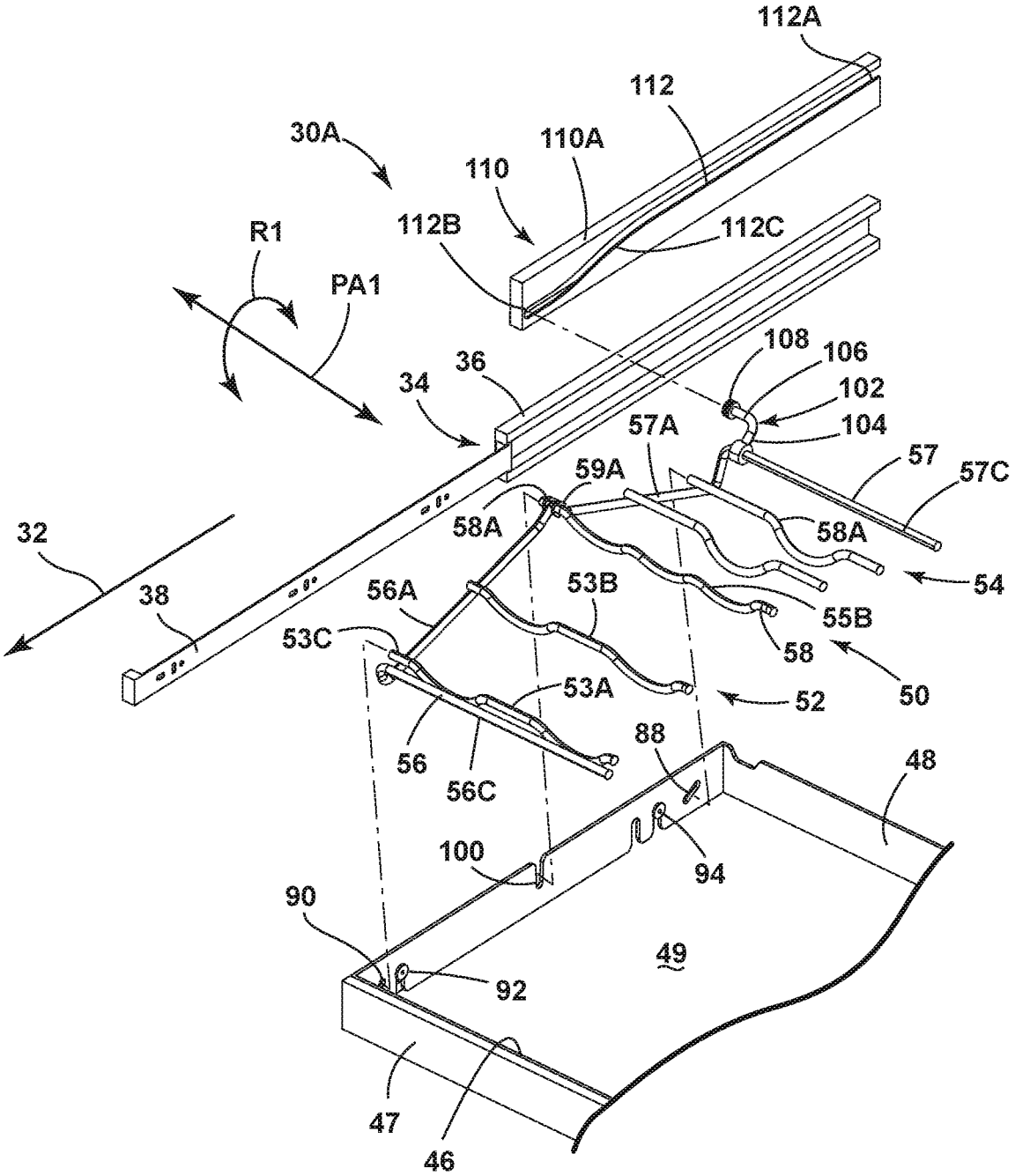
FIG. 11 is an exploded top perspective view of the shelf assembly of FIG. 8.

Referring now to FIG. 11, the rack assembly 50 engages the first side member 42A of the frame assembly 40, much the same way that the rack assembly 50 engages the first side member 42 described about with reference to FIG. 5. Thus, the end portion 55C of support member 55A of the rear rack 54 of the rack assembly 50 is pivotally and slidably received within the angled slot 88 of the first side member 42A. The end portion 53C of the support member 53A of the front rack 52 of the rack assembly 50 is pivotally received within the receiving aperture 90 disposed through the first side member 42A. In this way, front rack 52 and the rear rack 54 of the rack assembly 50 are pivotally coupled to the first side member 42A of the frame assembly 40 for movement of the rack assembly 50 between the first and second positions. The end portion 58A of the centrally disposed support member 58 is received in the upwardly opening slot 100, when the rack assembly 50 is in the first position, and is lifted from the upwardly opening slot 100 when the rack assembly 50 moves from the first position (FIG. 12A) to the second position (FIG. 12C). In FIG. 11, the guide pin 102 is shown having an engagement member 108 that is configured to couple the guide pin 102 to the elongate slot 112 of the guide member 110.

Figure 12A:
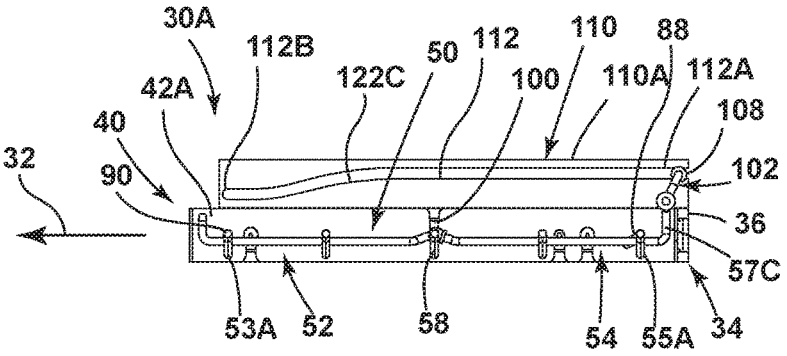
FIGS. 12A-12C are cross-sectional side elevation views of the shelf assembly of FIG. 8 showing relative movement of the frame assembly from the stowed position to the extended position and relative movement of the rack assembly from the first position to the second position.
Figure 12B:
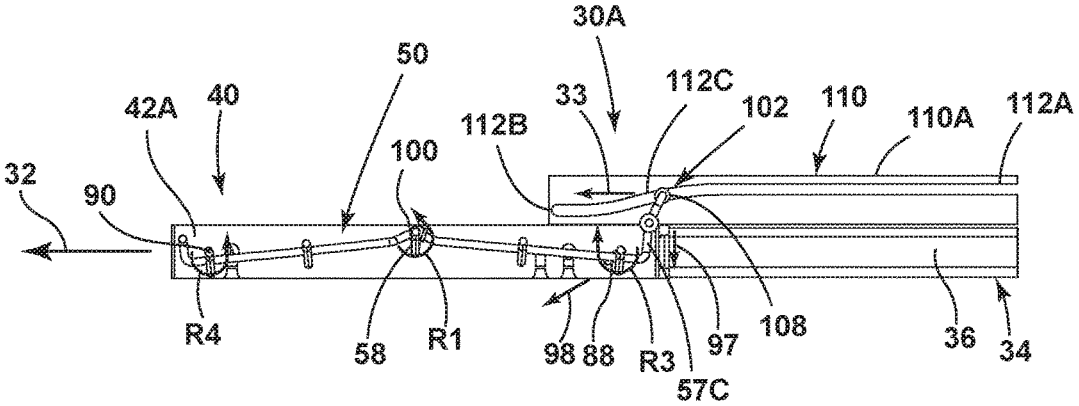
Figure 12C:
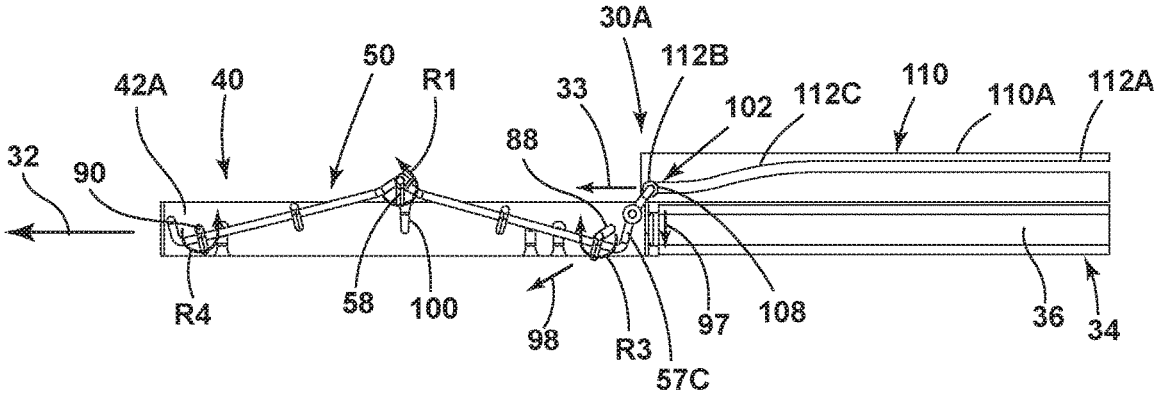

Referring now to FIG. 12A, the shelf assembly 30A is shown with the frame assembly 40 in the stowed position. With the frame assembly 40 in the stowed position, the rack assembly 50 is in the first position configured for horizontal storage of bottles as described above. As shown in FIG. 12B, the rack assembly 50 remains in the first position as the frame assembly 40 begins its initial outward movement towards the extended position from the stowed position along the path indicated by arrow 32. In FIG. 12B, the guide pin 102 has moved from the first end 112A of the elongate slot 112 of the guide member 110 towards the second end 112B of the elongate slot 112. As noted above, the second end 112B of the elongate slot 112 is vertically offset from the first end 112A as provided by the angled portion 112C of the elongate slot 112. In FIG. 12B, the guide pin 102 is positioned at the angled portion 112C of the elongate slot 112 and has started to descend down the angled portion 112C of the elongate slot 112. Thus, as the frame assembly 40 continues its outward movement towards the fully extended position along the path indicated by arrow 32, the guide pin 102 moves the rack outward along the path indicated by arrow 33 and downward along the path indicated by arrow 97.

With further reference to FIG. 12B, the front and rear racks 52, 54 of the rack assembly 50 begin lifting upward towards the second position of the rack assembly 50. This is due to the downward movement of the guide pin 102 as the guide pin 102 travels along the elongate slot 112 of the guide member 110. To accommodate this downward movement of the rack assembly 50, the support member 55A of the rear rack 54 moves downwardly in the direction as indicated by arrow 98 along the third slot 88 that is downwardly angled along the first side member 42A of the frame assembly 40. Thus a rear portion of the rear rack 54 is driven downward along the downwardly angled third slot 88. The rear rack 54 also pivots in the direction as indicated by arrow R3 at the interconnection between the support member 55A of the rear rack 54 as received within the third slot 88. Similarly, the front rack 52 also pivots in the direction as indicated by arrow R4 at the interconnection between the support member 53A of the front rack 52 and receiving aperture 90 of the first side member 42A of the frame assembly 40. Thus, at the respective support members 53A, 55A thereof, the front and rear racks 52, 54 of the rack assembly 50 pivot in opposite directions (R3. R4) with respect to the first side member 42A of the frame assembly 40. The front and rear racks 52, 54 of the rack assembly 50 further pivot with respect to one another along the direction as indicated by arrow R1 at the pivot axis PA1 of the rack assembly 50, as best shown in FIG. 11. As the front and rear racks 52, 54 of the rack assembly 50 further pivot with respect to one another along the direction as indicated by arrow R1, the centrally disposed support member 58 is lifted from the upwardly opening slot 100 of the first side member 42A of the frame assembly 40.

Referring now to FIG. 12C, the frame assembly 40 is in the fully extended position and the rack assembly 50 is shown in the raised second position for inclined presentation of bottles supported thereon. Thus, the movement of the guide pin 102 along the path indicated by arrows 33 and 97 has provided for a downward and forward movement of the rear rack 54 relative to the front rack 52 along the path indicated by arrow 98, such that the front and rear racks 52, 54 of the rack assembly 50 have pivoted with respect to one another (R1) to lift the front and rear racks 52, 54 of the rack assembly 50 to the second position. The support member 55A of the rear rack 54 is shown as having reached the end of the third slot 88 of the first side member 42A of the frame assembly 40.

Figure 13:
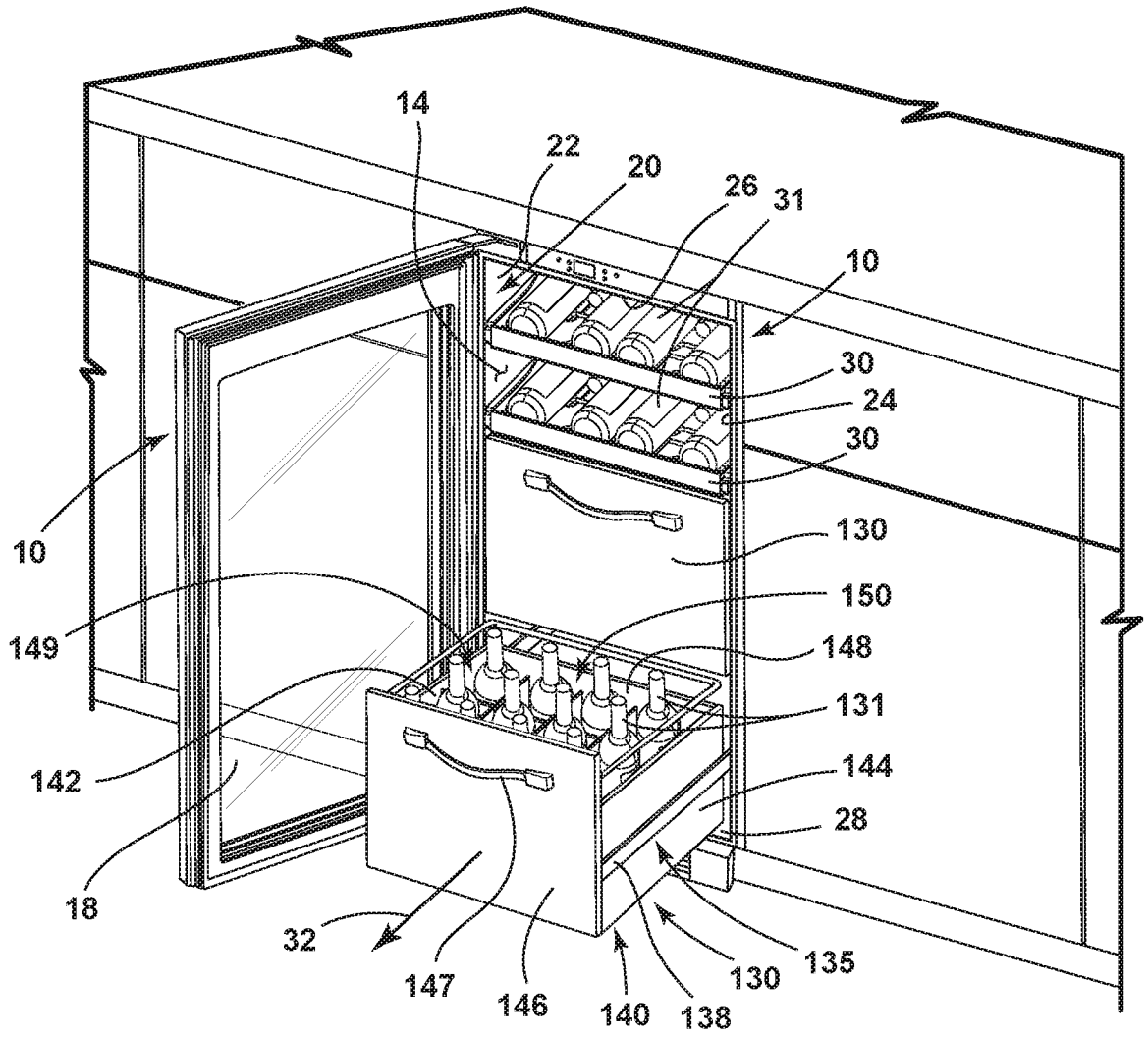
FIG. 13 is a perspective view of a refrigerated appliance having a plurality of drawer assemblies disposed therein and shown in stowed and extended positions.

Referring now to FIG. 13, the refrigerated appliance 10 of FIGS. 1A and 1B is shown having two shelf assemblies 30, along with two drawer assemblies 130 disposed within the storage compartment 14 of the cabinet 12. Other numbers of shelf assemblies and drawer assemblies may be incorporated into an overall layout of the storage compartment 14 without departing from the spirit of the present concept. The drawer assemblies 130 are configured to slide between stowed and extended positions along the path indicated by arrow 32, much like the shelf assemblies 30, 30A described above. In FIG. 13, an upper drawer assembly 130 is shown in the stowed or retracted position, wherein the entirety of the drawer assembly 130 is received within the storage compartment 14 of the cabinet 12. As further shown in FIG. 13, a lower drawer assembly 130 is shown in the extended position, wherein the extended drawer assembly 130 provides access to bottles 131 disposed in an upright position within the drawer assembly 130. Bottles 131 stored in the drawer assembly 130 are contemplated to include all the portions of the bottles 131 described above and shown in FIG. 13 positioned on the shelf assemblies 30 positioned above the drawer assembly 130.

As further shown in FIG. 13, the drawer assembly 130 includes a frame assembly 140 having first and second side members 142, 144, and front and rear frame members 146, 148 that interconnect the first and second side members 142, 144. The first and second side members 142, 144 are spaced-apart from one another or otherwise opposed to one another. Similarly, the front and rear frame members 146, 148 are spaced-apart from one another or otherwise opposed to one another. In this way, first and second side members 142, 144 and the front and rear frame members 146, 148 of the frame assembly 140 cooperate to define a centrally disposed storage space 149. The front frame member 146 may include a handle 147 coupled thereto for engagement by a user to pull and push the drawer assembly 130 into and out of the cabinet 12 of the refrigerated appliance.

Within the centrally disposed storage space 149 of the drawer assembly 130, a grid assembly 150 is positioned having a plurality of interconnected cross members 152, 154, as best shown in FIGS. 16A and 16B. With the frame assembly 140 of the drawer assembly 130 in the extended position, the storage space 149 can be vertically loaded with bottles 131 by a user. When the frame assembly 140 of the drawer assembly 130 is in the stowed or retracted position, the bottles 131 are moved from the upright position (shown in the lower drawer assembly 130 of FIG. 13) to an angled position, wherein a liquid provided in the bottles 131 can contact a sealing member of the bottles 131, such as a wine bottle in an angled position, wherein the wine within the bottle can contact a cork to help keep the cork from drying out, thereby potentially causing the wine bottle to lose its seal. For filling the storage space 149 of the drawer assembly 130, the upright vertical access to the storage space 149 of the drawer assembly 130 facilitates easy loading of bottles 131 therein.

Figure 14A:
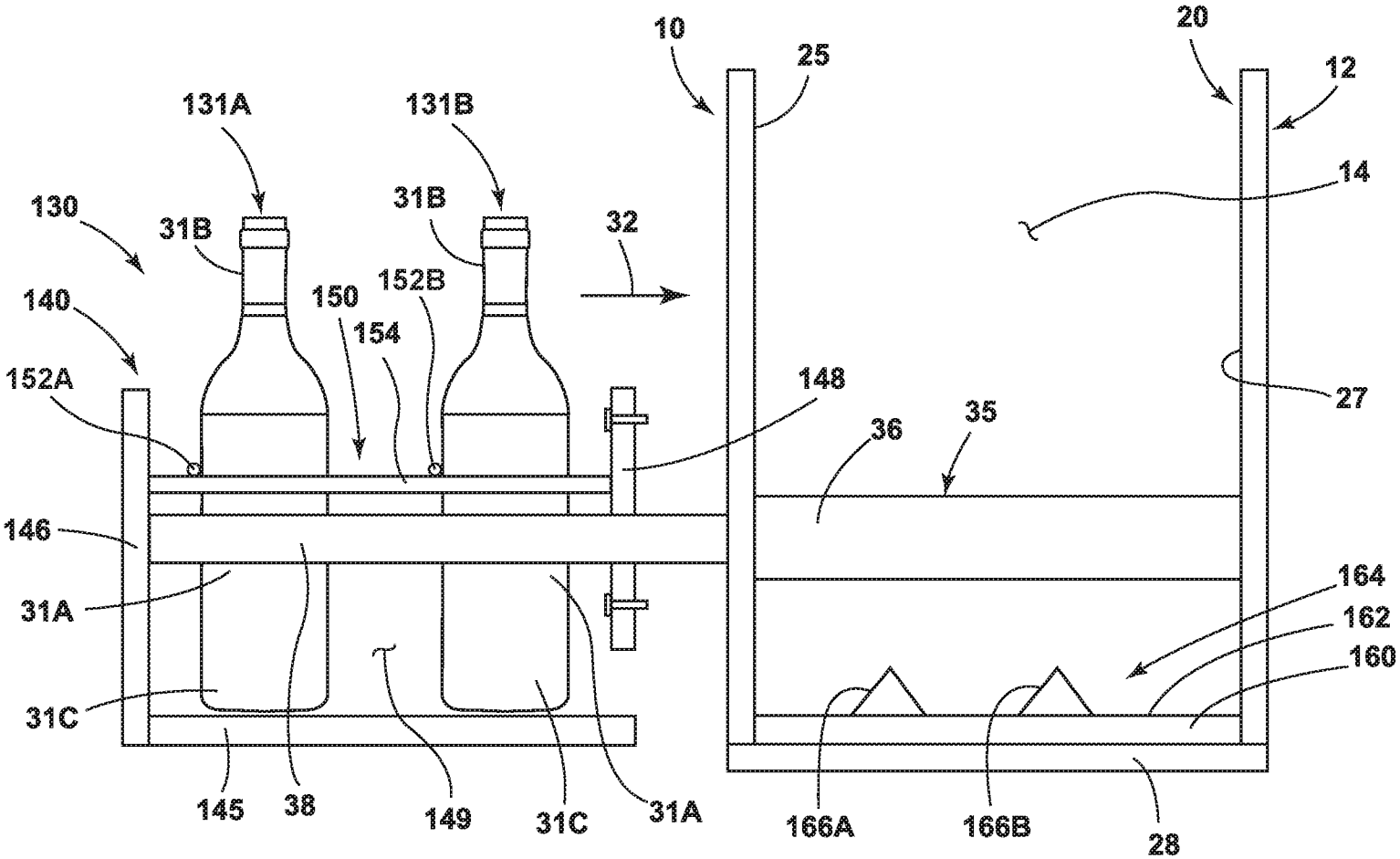
FIG. 14A is a side elevation view of a drawer assembly in an extended position with a plurality of bottles supported therein in an upright configuration.

Referring now to FIG. 14A, the refrigerated appliance 10 is shown with a sidewall removed therefrom to reveal the storage compartment 14 of the cabinet 12. In the simple representation of FIG. 14A, the liner 20 of the cabinet 12 includes front and rear walls 25, 27 which outwardly extend from the bottom wall 28. A slide assembly 35 is shown in FIG. 14A having the cabinet member 36 disposed within the storage compartment 14 of the cabinet 12. The drawer member 38 is coupled to the frame assembly 140 of the drawer assembly 130. The drawer assembly 130 is shown in FIG. 14A with the first or second side members 142, 144 removed to reveal the storage space 149 thereof. However, it is contemplated that the drawer member 38 would be coupled to one of the first or second side members 142, 144 in assembly. Similar to the manner described above, the cabinet member 36 of the slide assembly 35 is fixedly coupled to the cabinet 12. This coupling is likely made at the liner 20 of the refrigerated appliance 10 along one of the first or second sidewalls 22, 24 thereof. The drawer member 38 is slidably received by the cabinet member 36 between extended and retracted positions. In FIG. 14A, the drawer assembly 130 is shown having the frame assembly 140 in the extended position, wherein the bottles 131A, 131B can be vertically loaded into the storage space 149 of the drawer assembly 130 while the storage space 149 is extended outside of the storage compartment 14 of the refrigerated appliance 10. The bottles 131A, 131B are shown in FIG. 14A as being loaded into the grid assembly 150 between cross members 152A, 152B and 154. The bottles 131A, 131B shown in FIG. 14A are contemplated to include all of the various portions of bottles 131 and bottles 31 described above. As received within the storage space 149 of the drawer assembly 140, the bottles 131A, 131B are supported on a bottom wall 145 of the drawer assembly 140 in a generally upright position.

Figure 14B:
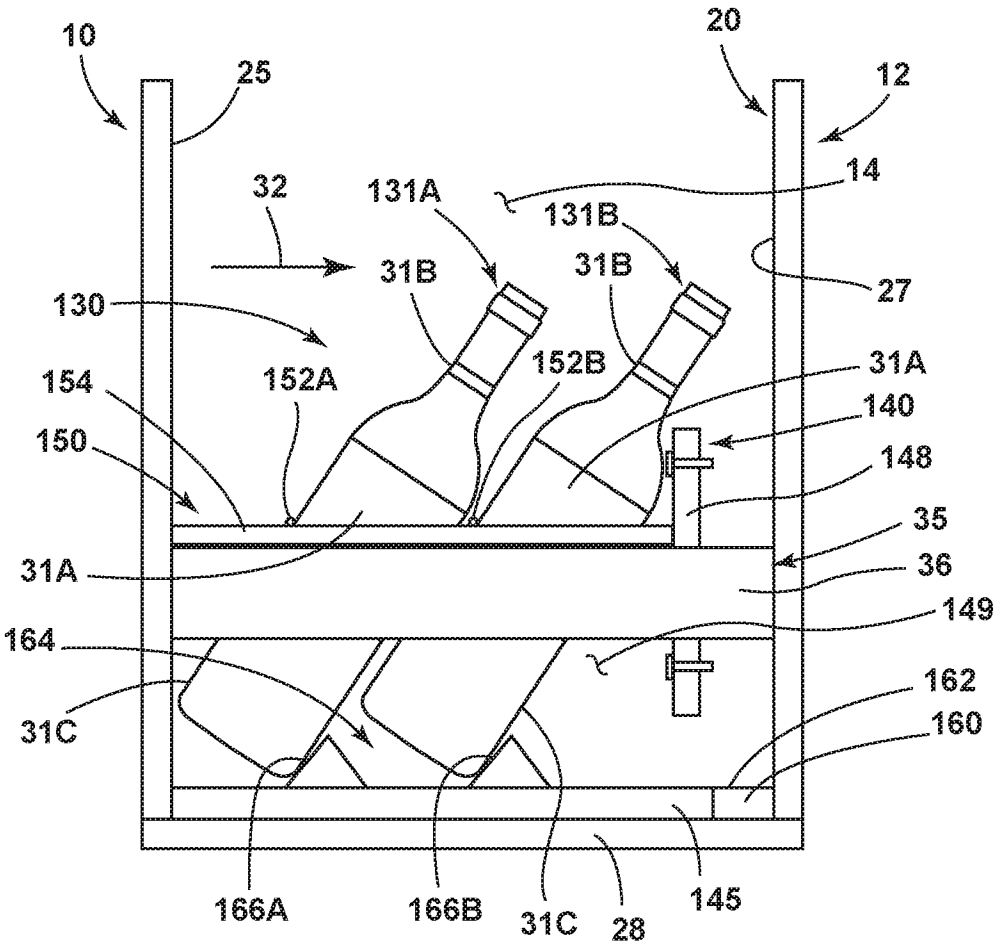
FIG. 14B is a side elevation view of the drawer assembly of FIG. 14A in a stowed position with the plurality of bottles supported therein in an angled storage configuration.

As further shown in FIG. 14A, the storage compartment 14 of the refrigerated appliance 10 includes a support member 160 having an upper surface 162 upon which a plurality of engagement members 164 is positioned. Specifically, in the embodiment shown in FIG. 14A, first and second engagement members 166A, 166B are shown supported on the upper surface 162 of the support member 160. The support member 160, and the engagement members 166A, 166B thereof, are contemplated to be fixedly mounted within the storage compartment 14 of the refrigerated appliance 10 and aligned with an associated drawer assembly, such as drawer assembly 130 shown in FIG. 14A. In this way, the engagement members 166A, 166B can engage associated bottles, such as bottles 131A, 131, respectively, with which they are aligned, as the bottles 131A and 131B are moved into the storage compartment 14 of the refrigerated appliance 10 by the frame assembly 140 of the drawer assembly 130 moving in the direction as indicated by arrow 32 to the retracted or stowed position, as shown in FIG. 14B. In the embodiment shown in FIG. 14A, the engagement members 166A, 166B are shown in the form of triangularly-shaped members, however, it is contemplated that the engagement members 166A, 166B can be of any configuration that upwardly extend enough to engage respective bottles 131A, 131B stored in the storage space 149 of drawer assembly 130.

Referring now to FIG. 14B, the frame assembly 140 of the drawer assembly 130 is shown in the stowed or retracted position within the storage compartment 14 of the cabinet 12. With the frame assembly 140 in the stowed position, the bottles 131A, 131B positioned within the storage space 149 defined by the frame assembly 140 have tilted to an angled storage position as the bottom portions 31C of the bottles 131A, 131B have engaged the respective engagement members 166A, 166B positioned on an upwardly extending from the support member 160. Thus, as the bottles 131A, 131B move into the storage compartment 14 of the refrigerated appliance 10, the bottom portions 31C thereof will engage engagement members 166A, 166B, respectively, to stop the inward movement along the path as indicated by arrow 32 of the bottom portions 31C of the bottles 131A, 131B. The body portions 31A and neck portions 31B of the bottles 131A, 131B will continue movement further into the storage space 149 with the frame assembly 140 as urged by the cross members 152A, 152B of the grid assembly 150 of the drawer assembly 130. Specifically, the front cross member 152A of the grid assembly 150 will engage the front bottle 131A at the body portion 31A or neck portion 31B of the front bottle 131A, such that the overall front bottle 131A will tilt towards the angled position when the bottom portion 31C thereof is engaged with the associated engagement member, which is engagement member 166A. Similarly, the rear cross member 152B of the grid assembly 150 will engage the rear bottle 131B at the body portion 31A or neck portion 31B of the rear bottle 131B, such that the overall rear bottle 131B will tilt towards the angled position when the bottom portion 31C thereof is engaged with the associated engagement member, which is engagement member 166B. The angled position of the bottles 131A, 131B stored in the refrigerated appliance 10 allows the wine within the bottle to contact a cork to help keep the cork from drying out, thereby helping to ensure that the seal on the wine bottle is not lost during storage. Staggered arrangements of bottles and associated support members are further described below.

Figure 15A:
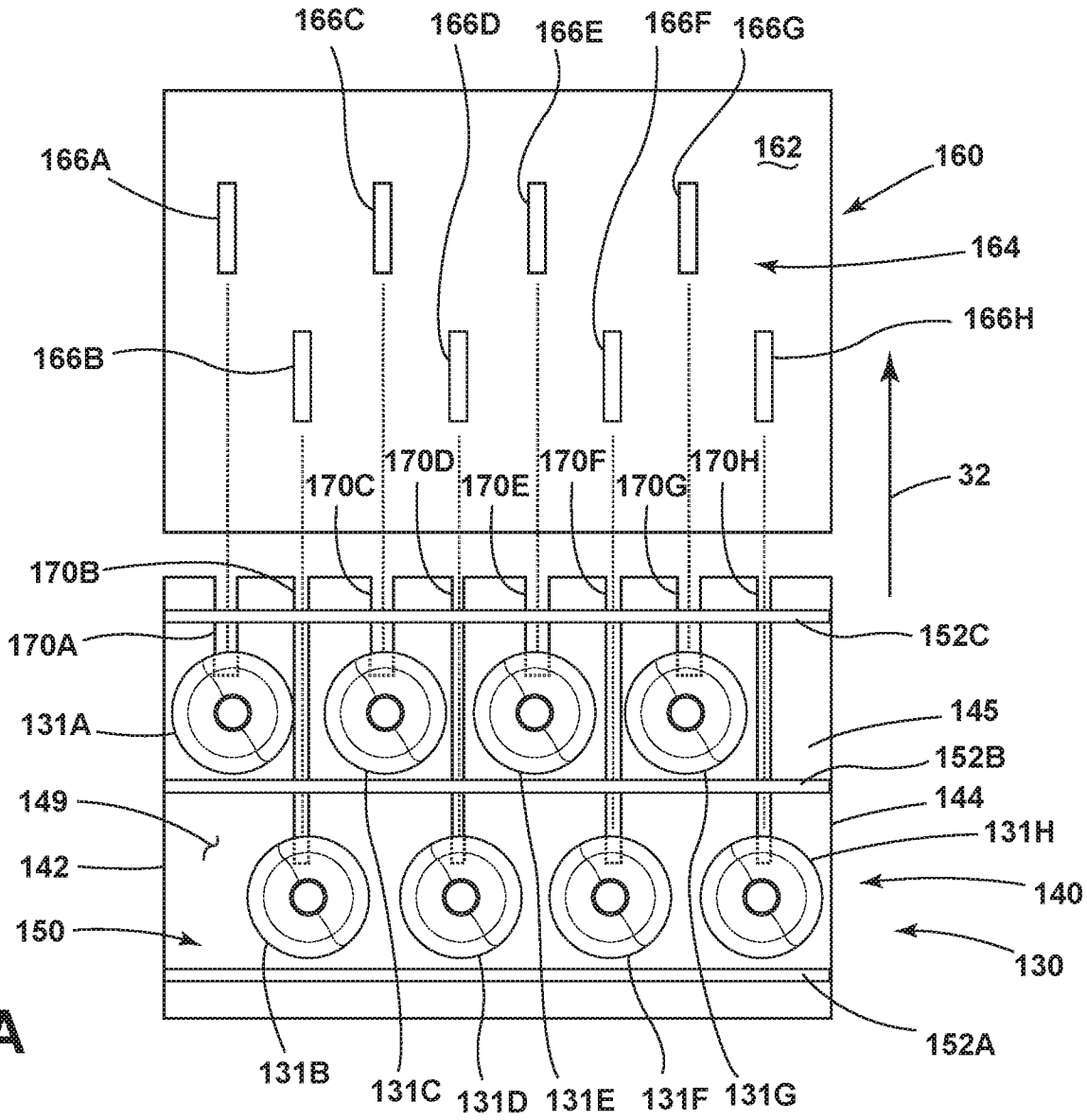
FIG. 15A is a top plan view of a drawer assembly in an extended position with a plurality of bottles supported therein in an upright configuration.

Referring now to FIG. 15A, a drawer assembly 130 is shown having a frame assembly 140 in an extended position relative to a support member 160. In the embodiment shown in FIG. 15A, the refrigerated appliance and associated slide assemblies have been removed to focus on the relationship between the drawer assembly 130 and the support member 160. The drawer assembly 130 is shown having bottles 131A-131H disposed in a staggered configuration, wherein bottles 131A, 131C, 131E, 131G are positioned in a rear row within the storage space 149, and bottles 131B, 131D, 131F, 131H are positioned in a front row within the storage space 149. The bottles 131A-131H are all received within the grid assembly 150 which includes first, second and third cross members 152A, 152B, 152C. Bottles 131B, 131D, 131F, 131H are associated with the first cross member 152A, while bottles 131A, 131C, 131E, 131G are associated with the second cross member 152B, as further described below. The first and second cross members 152A, 152B generally span the distance between opposed sides of the bottom wall 145 of the frame assembly 140 of the drawer assembly 130. It is contemplated that other cross members may be part of the grid assembly 150 and positioned in opposed directions to the first, second and third cross members 152A, 152B, 152C to interconnect the same and provide compartments for each bottle 131A-131H. In the embodiment shown in FIG. 15A, the opposed cross members have been removed to better show other features of the drawer assembly 130.

As further shown in FIG. 15A, the support member 160 includes staggered engagement members 166A-166H, wherein engagement members 166A, 166C, 166E, 166G are positioned in a rear row on the support member 160, and engagement members 166B, 166D, 166F, 166H are positioned in a front row on the support member 160. As shown in the embodiments of FIGS. 14A and 14B, the support member 160 is contemplated to be fixedly received within the cabinet 12 of the refrigerated appliance 10. The support member 160 is also contemplated to be fixedly supported within the cabinet 12 of a refrigerated appliance 10. Thus, the drawer assembly 130 moves in the direction as indicated by arrow 32 towards the support member 160, such that the bottles 131A-131H can engage the associated engagement members 166A-166H, as further described below.

Figure 15B:
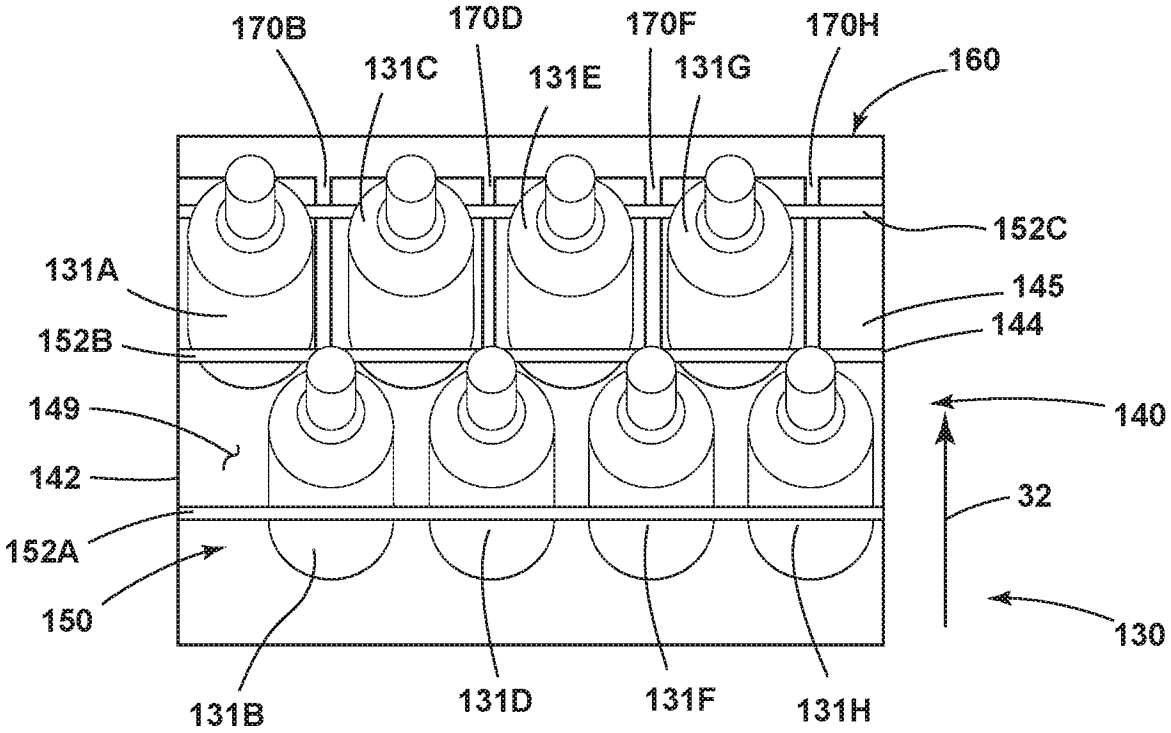
FIG. 15B is a top plan view of the drawer assembly of FIG. 15A in a stowed position with the plurality of bottles supported therein in an angled storage configuration.

As further shown in FIG. 15A, the bottom wall 145 of the frame assembly 140 includes a plurality of slots 170A-170H disposed through the bottom wall 145. The slots 170A-170H are aligned with the respective bottles 131A-131H, which are further aligned with the respective engagement members 166A-166B, as indicated by the dashed lines in FIG. 15A. Thus, as the drawer assembly 130 moves in the direction as indicated by arrow 32, the frame assembly 140 thereof will move towards a vertically juxtaposed position relative to the support member 160. During this movement towards the retracted position, the engagement members 166A-166B upwardly extending from the upper surface 162 of the support member 160 will be received in the associated slots 170A-170H of the bottom wall 145 of the frame assembly 140, such that the inward movement of the frame assembly 140 is not hindered by the upwardly extending engagement members 166A-166G. In this way, the engagement members 166A-166G can engage the bottom portions 31C of the bottles 131A-131G as the bottom wall 145 of the frame assembly 140 moves over the support member 160. This engagement stops the inward movement of the bottom portions 31C of the bottles 131A-131G, while the frame assembly 140, and the grid assembly 150 thereof, continue movement towards the fully retracted or stowed position of the frame assembly 140. To tip the bottles 131A-131G towards the angled storage position, the first cross member 152A of the grid assembly 150 will engage bottles 131B, 131D, 131F, 131H after the engagement members 166B, 166D, 166F, 166H have engaged the bottom portions 31C of the bottles 131B, 131D, 131F, 131H. The engagement between the still moving first cross member 152A and the bottles 131B, 131D, 131F, 131H tips the bottles towards the angled storage position. The same is true for the engagement of the second cross member 152B and the bottles 131A, 131C, 131E, 131G. The tipped storage configuration of the bottles 131A-131H is shown in FIG. 15B. It is contemplated that movement of the frame assembly 140 from the stowed position (FIG. 15B) to the extended position (FIG. 15A) will tipped the bottles 131A-131H to the upright position by the engagement of the bottles 131B, 131D, 131F, 131H with the second cross member 152B, and the engagement of the bottles 131A, 131C, 131E, 131G with the third cross member 152C.

Figure 16:
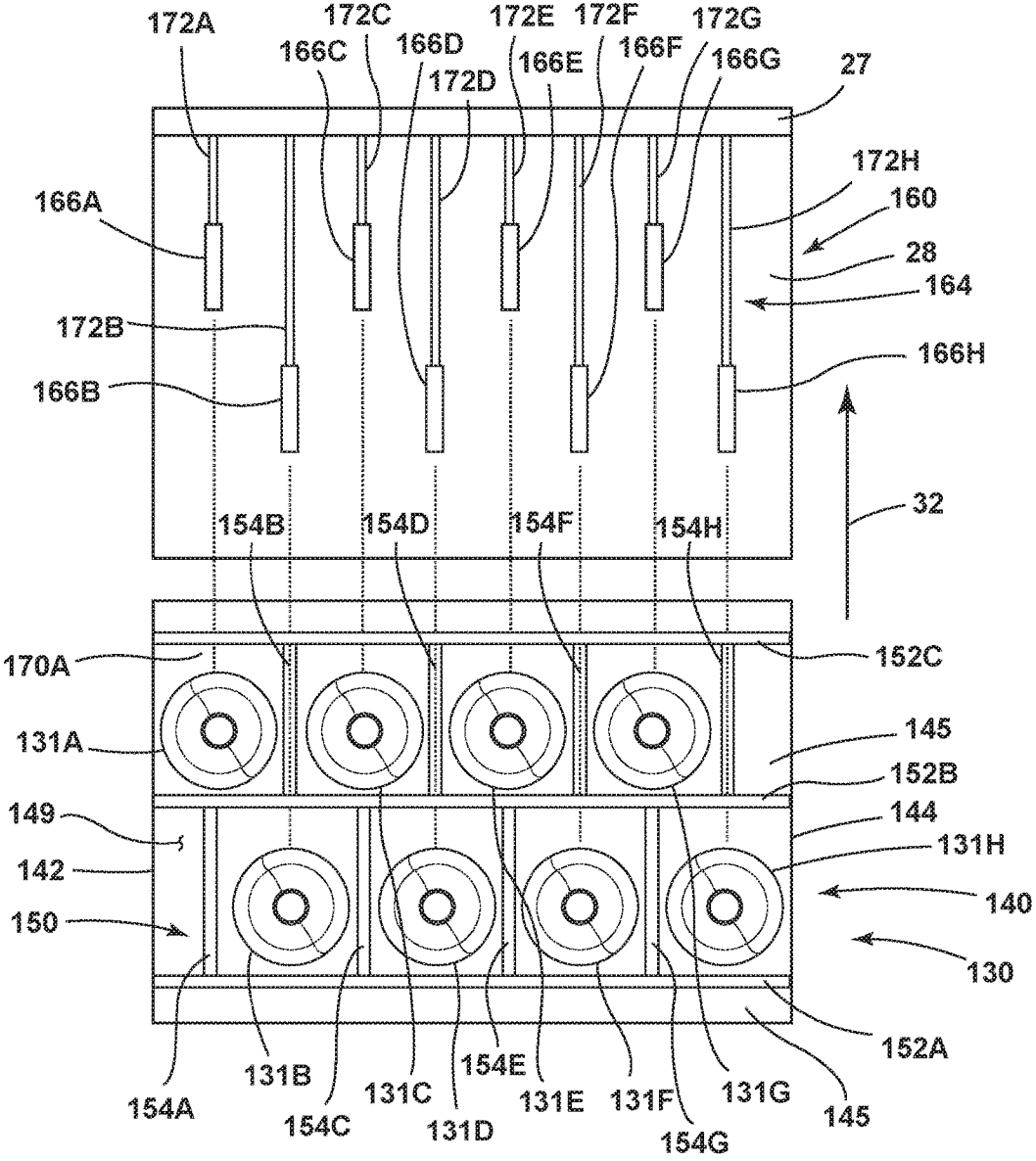
FIG. 16 is a top plan view of a drawer assembly in an extended position with a plurality of bottles supported therein in an upright configuration.

Referring now to FIG. 16, the bottles 131A-131H are shown vertically loaded into the storage space 149 of the frame assembly 140 within the grid assembly 150. The grid assembly 150 includes the cross members 152A-152C described above, as well as cross members 154A-154G which are disposed in substantially perpendicular directions relative to cross members 152A-152C and define individual compartments within the grid assembly 150 for each of the wine bottles 131A-131H to be received. As further shown in FIG. 16, staggered engagement members 166A-166H are positioned on support posts 172A-172H, respectively. The support posts 172A-172G are shown coupled to the rear wall 27 of the cabinet 12 in this way, the engagement members 166A-166H are suspended over the bottom wall 28 of the cabinet 12 by the outwardly extending support posts 172A-172H. In the configuration of FIG. 16, engagement members 166A, 166C, 166E, 166G define a rear row of engagement members, and engagement members 166B, 166D, 166F, 166H define a front row of engagement members. Thus, bottles 131A, 131C, 131E, 131G are configured to engage engagement members 166A, 166C, 166E, 166G, while bottles 131B, 131D, 131F, 131H are configured to engage engagement members 166B, 166D, 166F, 166H when the frame assembly 140 of the drawer assembly 130 is moved from the extended position to the stowed position.

Figure 17:
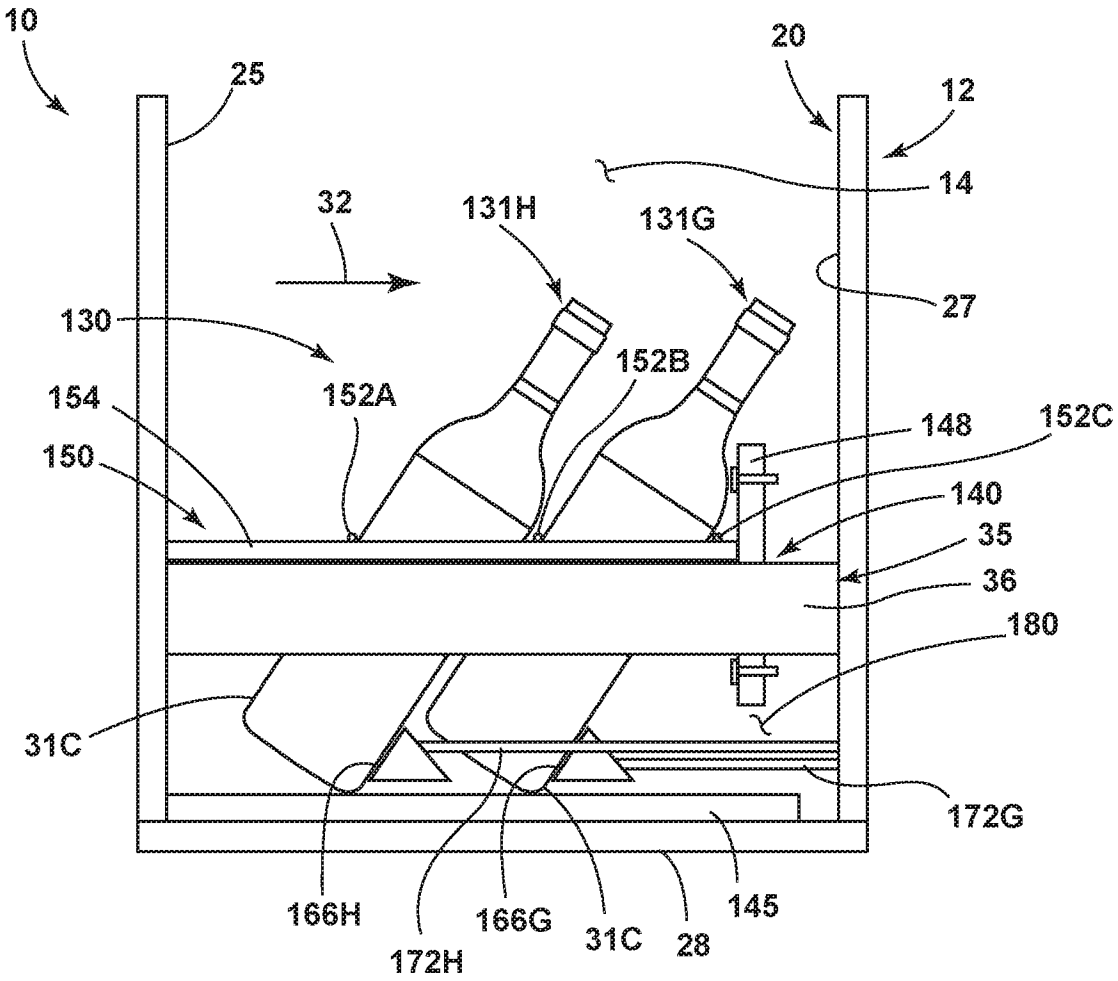
FIG. 17 is a side elevation view of the drawer assembly of FIG. 16 in a stowed position with the plurality of bottles supported therein in an angled storage configuration.

Referring now to FIG. 17, the tipped storage configuration of the bottles 131A-131H is shown. To tip the bottles 131A-131H towards the angled storage position, the first cross member 152A of the grid assembly 150 has engaged bottles 131B, 131D, 131F, 131H after the engagement members 166B, 166D, 166F, 166H have engaged the bottom portions 31C of the bottles 131B, 131D, 131F, 131H. In FIG. 17, bottle 131H of this collection of bottles is shown in the tipped position given the side elevation view of FIG. 17. The engagement between the still moving first cross member 152A and the bottles 131B, 131D, 131F, 131H has tipped the bottles 131B, 131D, 131F, 131H towards the angled storage position. The same is true for the engagement of the second cross member 152B and the bottles 131A, 131C, 131E, 131G. In FIG. 17, bottle 131G of this collection of bottles is shown in the tipped position given the side elevation view of FIG. 17. As further shown in FIG. 17, the frame assembly 140 of the drawer assembly 130 includes a gap 180 provided between the rear frame member 148 and the bottom wall 145 of the frame assembly 140, through which the engagement members 166A-166H, and the associated support posts 172A-172G upon which the engagement members 166A-166H are suspended, can be received to engage the associated bottles 131A-131H without impeding closing movement of the frame assembly 140 of the drawer assembly 130.

According to one aspect of the present disclosure, a shelf assembly includes a frame assembly that is displaceably associated with at least one rail member at a side member of the frame assembly between stowed and extended positions. A rack assembly includes a front rack hingedly coupled to a rear rack. The front rack and the rear rack are pivotally coupled to the side member of the frame assembly. A linkage assembly includes first and second arms. The first arm includes a first end that is slideably coupled to the rail member and the side member of the frame assembly and a second end that is slideably coupled to the side member of the frame assembly. The second end of the first arm is rotatably coupled to a first end of the second arm. A second end of the second arm is operably coupled to the rack assembly.

According to another aspect of the present disclosure, the rack assembly is operable between first and second positions, and further wherein the front rack and the rear rack are angled towards a pivot axis defined between the front rack and the rear rack in the second position.

According to another aspect of the present disclosure, the rack assembly moves from the first position to the second position as the frame assembly moves from the stowed position to the extended position.

According to another aspect of the present disclosure, the second arm of the linkage assembly is operable between raised and lowered positions, and further wherein the front rack and the rear rack are angled towards a pivot axis defined between the front rack and the rear rack when the second arm is in the raised position.

According to another aspect of the present disclosure, the second arm of the linkage assembly moves from the lowered position to the raised position as the frame assembly moves from the stowed position to the extended position.

According to another aspect of the present disclosure, the first end of the first arm is slideably coupled with the at least one rail member at an elongate slot disposed through the at least one rail member.

According to another aspect of the present disclosure, the elongate slot includes a downwardly turned end portion.

According to another aspect of the present disclosure, the side member of the frame assembly includes a first slot and a second slot, wherein the first end of the first arm of the linkage assembly is slideably coupled with the first slot of the side member, and further wherein the second end of the first arm of the linkage assembly is slideably coupled with the second slot of the side member.

According to yet another aspect of the present disclosure, the side member of the frame assembly includes a third slot, wherein the rear rack of the rack assembly is pivotally and slideably coupled to the third slot of the side member.

According to another aspect of the present disclosure, a shelf assembly includes a frame assembly that is operably coupled to a slide assembly for movement between stowed and extended positions. A rack assembly includes a front rack that is hingedly coupled to a rear rack. The front rack and the rear rack are pivotally coupled to a side member of the frame assembly. A guide pin is operably coupled to the rack assembly and outwardly extends therefrom. A guide member includes an elongate slot, and a portion of the guide pin is received in the elongate slot for movement therealong. The guide pin moves from a first end of the elongate slot to a second end of the elongate slot as the frame assembly moves from the stowed position to the extended position.

According to another aspect of the present disclosure, the first end of the elongate slot is vertically offset from the second end of the elongate slot.

According to another aspect of the present disclosure, the rack assembly is operable between first and second positions, and further wherein the front rack and the rear rack are angled towards a pivot axis defined between the front rack and the rear rack in the second position.

According to another aspect of the present disclosure, the rack assembly moves from the first position to the second position as the frame assembly moves from the stowed position to the extended position.

According to another aspect of the present disclosure, the first end of the elongate slot is positioned vertically above the second end of the elongate slot.

According to another aspect of the present disclosure, the side member of the frame assembly includes a downwardly angled slot disposed thereon, and further wherein the rear rack of the rack assembly is pivotally and slideably coupled to the downwardly angled slot of the side member.

According to another aspect of the present disclosure, the a rear portion of the rear rack is driven downward along the downwardly angled slot as the guide pin moves from the first end of the elongate slot of the guide member to the second end of the elongate slot of the guide member.

According to another aspect of the present disclosure, the side member of the frame assembly includes an upwardly opening slot, and further wherein a portion of a support member of the front rack is received in the upwardly opening slot of the side member when the frame assembly is in the stowed position, and further wherein the support member of the front rack is lifted out of engagement with the upwardly opening slot of the side member when the frame assembly is in the extended position.

According to yet another aspect of the present disclosure, a shelf assembly includes a frame assembly that is operably coupled to a slide assembly at a side member of the frame assembly for movement of the frame assembly between stowed and extended positions. A rack assembly includes a first rack hingedly coupled to a second rack. The first rack and the second rack are pivotally coupled to the side member of the frame assembly. The rack assembly is operable between first and second positions. The first rack and the second rack are angled towards a pivot axis defined between the first rack and the second rack in the second position. The rack assembly moves from the first position to the second position as the frame assembly moves from the stowed position to the extended position.

According to another aspect of the present disclosure, a linkage assembly having first and second arms, wherein the first arm is rotatably coupled to a first end of the second arm, and further wherein a second end of the second arm is operably coupled to the rack assembly.

According to another aspect of the present disclosure, a guide pin operably coupled to the rack assembly and outwardly extending therefrom and a guide member having an elongate slot, wherein a portion of the guide pin is received in the elongate slot for movement therealong, and further wherein the guide pin moves from a first end of the elongate slot to a second end of the elongate slot as the frame assembly moves from the stowed position to the extended position to drive the rack assembly to the second position.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cabinet, comprising:

a storage compartment having a support member fixedly mounted within the storage compartment, wherein the support member includes a plurality of engagement members upwardly extending therefrom;

a drawer assembly having a frame assembly with a bottom wall, wherein the drawer assembly is slideably coupled to the storage compartment between stowed and extended positions, and further wherein the bottom wall of the frame assembly is disposed over the support member of the storage compartment when the drawer assembly is in the stowed position, wherein the bottom wall of the frame assembly includes a plurality of slots, and further wherein each engagement member of the plurality of engagement members is aligned with and received in one of the slots of the plurality of slots of the bottom wall of the frame assembly when the drawer assembly is in the stowed position; and wherein the frame assembly includes first and second side members and front and rear frame members that interconnect the first and second side members, wherein the first and second side members are spaced-apart from one another and the front and rear frame members are spaced-apart from one another, such that the first and second side members and the front and rear frame members of the frame assembly cooperate to define a storage space, and further wherein the engagement members of the plurality of engagement members upwardly extend into the storage space of the frame assembly when the drawer assembly is in the stowed position.

2. The cabinet of claim 1, wherein each said engagement member of the plurality of engagement members upwardly extends beyond the bottom wall of the frame assembly when the drawer assembly is in the stowed position.

3. The cabinet of claim 1, wherein the drawer assembly includes at least one cross member interconnecting the first and second side members of the frame assembly to divide the storage space between a front portion and a rear portion.

4. The cabinet of claim 3, wherein the plurality of engagement members includes engagement members disposed in a staggered configuration on the support member to define a front row of engagement members and a rear row of engagement members that are laterally offset from one another.

5. The cabinet of claim 4, wherein the front row of engagement members extend upwardly into the front portion of the storage space when the drawer assembly is in the stowed position.

6. The cabinet of claim 5, wherein the rear row of engagement members extend upwardly into the rear portion of the storage space when the drawer assembly is in the stowed position.

7. A cabinet, comprising:

a storage compartment having a bottom wall and a plurality of engagement members suspended above the bottom wall; and a drawer assembly slideably coupled to the storage compartment between stowed and extended positions, wherein the drawer assembly includes a frame assembly defining a storage space, wherein the engagement members of the plurality of engagement members extend into the storage space of the frame assembly when the drawer assembly is in the stowed position, wherein each said engagement member of the plurality of engagement members is supported by a support post outwardly extending from a rear wall of the storage compartment, and further wherein the drawer assembly includes a grid assembly disposed over a bottom wall of the frame assembly.

8. The cabinet of claim 7, wherein the plurality of engagement members includes engagement members disposed in a staggered configuration.

9. The cabinet of claim 8, wherein the plurality of engagement members define a front row of engagement members and a rear row of engagement members.

10. The cabinet of claim 7, wherein the grid assembly includes one or more cross members interconnecting first and second side members that are spaced-apart from one another.

* * * * *